US010252852B2

(12) United States Patent
Newman

(10) Patent No.: US 10,252,852 B2
(45) Date of Patent: Apr. 9, 2019

(54) ADAPTIVE PACKAGING FOR FOOD PROCESSING SYSTEMS

(75) Inventor: Paul Bernard Newman, Fallbrook, CA (US)

(73) Assignee: JBT FOOD & DAIRY SYSTEMS B.V., Amsterdam (NL)

( * ) Notice: Subject to any disclaimer, the term of this patent is extended or adjusted under 35 U.S.C. 154(b) by 103 days.

(21) Appl. No.: 13/449,718

(22) Filed: Apr. 18, 2012

(65) Prior Publication Data

US 2012/0267264 A1 Oct. 25, 2012

Related U.S. Application Data

(60) Provisional application No. 61/478,190, filed on Apr. 22, 2011.

(51) Int. Cl.
*B65D 81/32* (2006.01)
*B65D 77/22* (2006.01)
*B65D 81/20* (2006.01)

(52) U.S. Cl.
CPC ..... *B65D 81/3261* (2013.01); *B65D 77/225* (2013.01); *B65D 81/2084* (2013.01); *B65D 2205/00* (2013.01)

(58) Field of Classification Search
CPC ..... B65D 81/3261; B65D 81/3272; B65D 81/2084; B65D 77/225; B65D 2205/00; (Continued)

(56) References Cited

U.S. PATENT DOCUMENTS 1,419,139 A 6/1922 Hunter
1,868,996 A 7/1932 Sharp
(Continued)

FOREIGN PATENT DOCUMENTS

CH EP 1359097 A1 11/2003
DE 018489 A1 10/2010
(Continued)

OTHER PUBLICATIONS

Nelson, "Principles of Aseptic Processing and Packaging", 2010, pp. 3-46, 101-150.
(Continued)

*Primary Examiner* — Erik Kashnikow
*Assistant Examiner* — Thanh H Nguyen
(74) *Attorney, Agent, or Firm* — Christensen O'Connor Johnson Kindness PLLC

(57) ABSTRACT

The present invention relates to a re-closable package, wherein at least one layer of said package is derived and fabricated essentially from a single piece of packaging material, has at least an inner and outer chamber, each capable of holding one or more separate or mixed solid or liquid food components. It also relates to one or more mechanisms within said package design and configuration preferentially allowing controlled movement of gas but not liquid and/or solids both within the package and/or from within the package to the outside. It further relates to a method for controlling and selectively modifying a number of processing conditions within said packaging, particularly pack pressure, gas volume and gas composition. It also relates to package design capability to accelerate and/or optimize product processing within any food sterilization or pasteurization system and its subsequent handling, storage and transportation without further modification.

20 Claims, 3 Drawing Sheets

Figure 3:
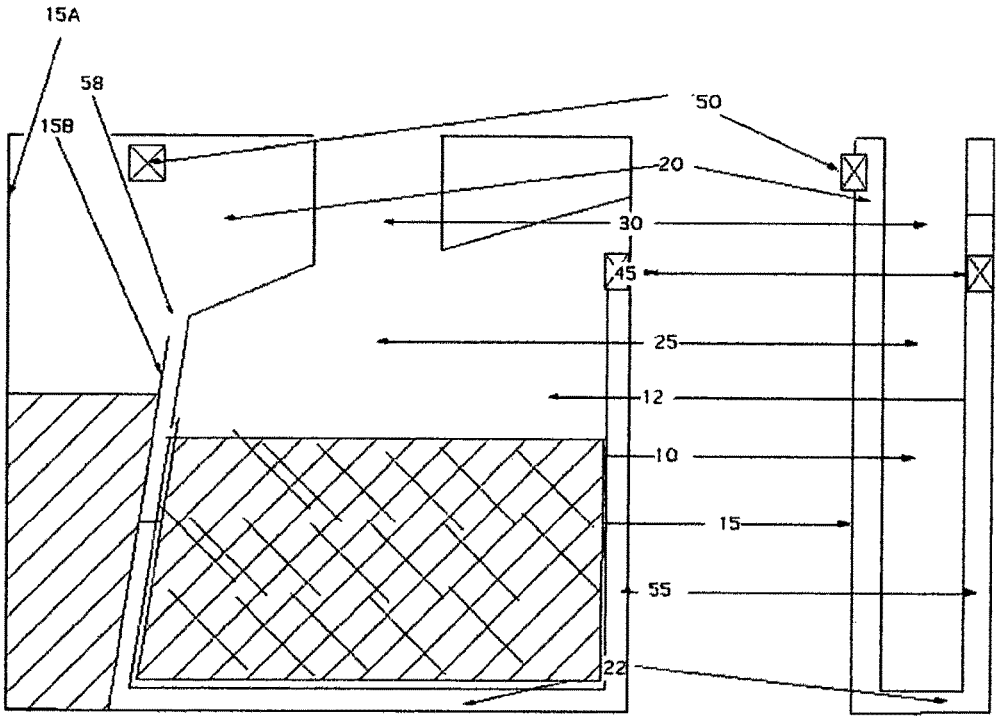

(58) Field of Classification Search
CPC ..... B65D 81/2023; B65D 81/3461; B65D 81/3266; B65D 33/01; B65D 81/343; B65D 75/008; B65D 31/12; B65D 75/328
USPC ..... 426/107, 118, 111, 119–120, 395, 410, 426/412, 113–114, 399, 401; 383/40, 38, 383/41, 100–101, 103, 5
See application file for complete search history.

(56) References Cited

U.S. PATENT DOCUMENTS 1,923,421 A 8/1933 Chapman
2,556,385 A 6/1951 Allan
2,595,708 A * 5/1952 Kopald et al. ..... 206/484.1
2,633,284 A * 3/1953 McFarland et al. ..... 220/202
2,660,512 A 11/1953 Webster
2,806,423 A 9/1957 Van Der Winden
2,818,012 A 12/1957 Webster
2,870,954 A * 1/1959 Kulesza ..... 206/524.8
2,968,232 A 1/1961 Carvallo
2,976,988 A * 3/1961 Schneider ..... 206/445
3,088,180 A 5/1963 Lauterbach
3,286,619 A 11/1966 Lee
3,377,173 A 4/1968 Winden
3,394,793 A 7/1968 Reimers et al.
3,407,721 A 10/1968 Carvallo
3,469,988 A 9/1969 Yawger
3,478,677 A 11/1969 Mencacci
3,545,985 A 12/1970 Mencacci et al.
3,637,132 A * 1/1972 Gray ..... 383/100
3,927,976 A 12/1975 Reimers et al.
3,960,670 A 6/1976 Pflug
4,067,691 A 1/1978 McGady et al.
4,116,117 A 9/1978 Bogaard
4,196,225 A 4/1980 Mencacci
4,206,299 A 6/1980 Yamazaki et al.
4,295,566 A * 10/1981 Vincek ..... 206/457
4,389,371 A 6/1983 Wilson et al.
4,396,582 A 8/1983 Kodera
4,476,263 A 10/1984 Owens
4,522,015 A 6/1985 Hildebolt
4,547,383 A 10/1985 Goldhahn
4,631,115 A 12/1986 Berg et al.
4,739,699 A 4/1988 Nelson et al.
4,816,269 A 3/1989 Nelson et al.
4,861,559 A 8/1989 Sugisawa et al.
4,990,347 A 2/1991 Rasmussen et al.
5,141,662 A 8/1992 Dexheimer et al.
5,160,755 A 11/1992 Mignogna et al.
5,218,829 A 6/1993 DeJarnette
5,240,725 A 8/1993 Akamatsu et al.
5,283,033 A 2/1994 Dodrill
5,307,985 A * 5/1994 Beizermann ..... 229/120
5,351,828 A * 10/1994 Becker et al. ..... 206/522
5,368,093 A 11/1994 Takehashi
5,370,174 A 12/1994 Silvestrini et al.
5,478,990 A 12/1995 Montanari et al.
5,484,547 A 1/1996 Mendoza
5,696,686 A 12/1997 Sanka et al.
5,711,984 A 1/1998 Woodward et al.
5,747,085 A 5/1998 Veltman et al.
5,759,486 A 6/1998 Peterson
5,839,832 A * 11/1998 Hagino ..... 383/101
5,857,312 A 1/1999 Walden
5,872,359 A 2/1999 Stewart et al.
5,894,929 A * 4/1999 Kai et al. ..... 206/524.8
6,017,572 A 1/2000 Meyer
6,025,189 A 2/2000 Bolea et al.
6,071,474 A 6/2000 Martinsen et al.
6,086,782 A 7/2000 Hsu et al.
6,090,425 A 7/2000 Samimi
6,096,358 A 8/2000 Murdick et al.
6,148,249 A 11/2000 Newman
6,251,337 B1 6/2001 Kane
6,389,828 B1 5/2002 Thomas
6,416,711 B2 7/2002 Weng
6,440,361 B2 8/2002 Weng
6,472,008 B2 10/2002 Weng
6,557,462 B1 * 5/2003 Wang ..... 99/472
6,868,873 B2 3/2005 Frisk
7,008,501 B2 3/2006 Lohwasser et al.
7,008,659 B1 3/2006 Ono
7,141,102 B2 11/2006 Fukutani et al.
7,178,555 B2 2/2007 Engel et al.
7,396,521 B2 7/2008 Hwang
7,452,561 B2 11/2008 Newman
7,475,786 B2 1/2009 McVay
7,533,512 B2 5/2009 Levati et al.
7,543,455 B1 6/2009 Chen
7,666,457 B1 2/2010 Lang et al.
7,846,486 B2 12/2010 Camu
7,880,887 B2 2/2011 Olson et al.
7,985,349 B2 7/2011 Yang et al.
8,181,474 B2 5/2012 Chen
8,206,607 B2 6/2012 Evans et al.
8,479,532 B2 7/2013 Cocchi et al.
8,575,525 B2 11/2013 Mackay et al.
2001/0041150 A1 11/2001 Weng
2003/0211212 A1 11/2003 Belongia et al.
2005/0040251 A1 2/2005 Daly
2005/0123435 A1 6/2005 Cutler et al.
2005/0253109 A1 11/2005 Tran et al.
2006/0038159 A1 2/2006 Fukutani et al.
2006/0051639 A1 3/2006 Yang et al.
2007/0122335 A1 5/2007 Hwang
2007/0160494 A1 7/2007 Sands
2007/0275178 A1 11/2007 Nishi et al.
2007/0293980 A1 12/2007 Gudjonsson et al.
2008/0011752 A1 * 1/2008 Saitoh ..... 220/203.29
2008/0048147 A1 2/2008 Eaton
2008/0107781 A1 * 5/2008 Carroll ..... 426/128
2008/0152537 A1 6/2008 Wild et al.
2008/0311259 A1 12/2008 Singh et al.
2008/0315152 A1 12/2008 Daly
2009/0022858 A1 * 1/2009 Pawlick ..... 426/113
2009/0057607 A1 3/2009 Evans et al.
2009/0081417 A1 3/2009 Schmal et al.
2009/0142223 A1 6/2009 Hyde et al.
2009/0169693 A1 7/2009 Hoffman
2009/0178928 A1 7/2009 Groos et al.
2009/0191318 A1 7/2009 Cocchi et al.
2009/0238937 A1 9/2009 Yamazaki et al.
2009/0301118 A1 12/2009 Chen
2009/0301119 A1 12/2009 Chen
2010/0006796 A1 1/2010 Yang et al.
2010/0006798 A1 1/2010 Yang et al.
2010/0047403 A1 * 2/2010 Johnson ..... 426/113
2010/0119670 A1 5/2010 Mazzariello
2010/0173060 A1 7/2010 Perren et al.
2010/0178404 A1 7/2010 Yoakim et al.
2011/0104350 A1 5/2011 Clüsserath et al.

FOREIGN PATENT DOCUMENTS

DE 102009018489 10/2010
EP 362975 4/1990
EP 808631 11/1997
EP 990689 4/2000
EP 2177116 4/2010
EP 2223618 9/2010
EP 2574243 B1 4/2014
GB 1206061 9/1970
GB 2285126 6/1995
GB 2408440 6/2005
GB 2427601 A 1/2007
GB EP 1964785 A2 9/2008
GB 2449288 A 11/2008
JP 2007-161807 6/2007
WO 198804145 6/1988
WO 1996011592 4/1996
WO 0027227 5/2000
WO 0027229 5/2000
WO 2002021928 3/2002
WO 200237975 5/2002
WO 2003018706 3/2003

(56) References Cited

FOREIGN PATENT DOCUMENTS

| | | | |
|---|---|---|---|
| WO | 0417741 | 3/2004 | |
| WO | 2006092376 | 9/2006 | |
| WO | 2007020469 | 2/2007 | |
| WO | 199807452 | 2/2008 | |
| WO | 2008093367 | 8/2008 | |
| WO | 2009005767 | 1/2009 | |
| WO | WO 2010026369 A1 * | 3/2010 | ..... B32B 7/02 |
| WO | 2010092360 | 8/2010 | |

OTHER PUBLICATIONS

U.S. Appl. No. 13/450,693 , "Non-Final Office Action", dated Nov. 8, 2013, 32 pages.
U.S. Appl. No. 13/450,693 , "Response to Non-Final Office Action", dated Mar. 7, 2014, 30 pages.
U.S. Appl. No. 13/450,693 , "Response to Restriction Requirement", dated Oct. 17, 2013, 7 pages.
U.S. Appl. No. 13/450,693 , "Restriction Requirement", dated Sep. 17, 2013, 6 pages.
U.S. Appl. No. 13/452,207 , "Non-Final Office Action", dated Feb. 14, 2014, 6 pages.
U.S. Appl. No. 13/464,997 , "Non-Final Office Action", dated Sep. 12, 2013, 11 pages.
U.S. Appl. No. 13/464,997 , "Response to Non-Final Office Action", dated Jan. 13, 2014, 22 pages.
U.S. Appl. No. 13/464,997 , "Response to Restriction Requirement", dated May 1, 2013, 6 pages.
U.S. Appl. No. 13/464,997 , "Restriction Requirement", dated Apr. 5, 2013, 13 pages.
U.S. Appl. No. 13/624,411 , "Non-Final Office Action", dated Mar. 11, 2014, 8 pages.
U.S. Appl. No. 13/624,411 , "Response to Restriction Requirement", dated Feb. 19, 2014, 8 pages.
U.S. Appl. No. 13/624,411 , "Restriction Requirement", dated Dec. 19, 2013, 6 pages.
U.S. Appl. No. 61/079,185 , "Continuous Monitoring, Measuring and Controlling the Properties of Artificial Casings with Special Reference to Cellulose and Fibrous Casings", filed Mar. 2009.
U.S. Appl. No. 61/182,696 , "Printing of Data, Logos and Coded or Uncoded Information on Wet Surfaces and High Moisture Content, Natural, Unprocessed and Processed Foodstuffs.", filed May 2009.
U.S. Appl. No. 61/182,731 , "Continuous Monitoring, Measuring and Controlling the Properties of Webs, Films and Tubular Casings with Special Reference to Cellulose and Fibrous Casings", filed May 2010.
U.S. Appl. No. 61/478,190 , "Adaptive Packaging for Food Processing Systems", filed Apr. 22, 2011.
U.S. Appl. No. 61/478,491 , "Apparatus and Method for Optimizing and Controlling food processing performance especially in continuous sterilizing or pasteurizing systems", filed Apr. 23, 2011.
U.S. Appl. No. 61/478,665 , "Accelerating, Optimizing and Controlling product cooling in food processing systems especially continuous sterilizing or pasteurizing systems", filed Apr. 25, 2011.
U.S. Appl. No. 61/480,521 , "Novel Continuous and Flexible food and drink processing technology", filed Apr. 29, 2011.
U.S. Appl. No. 61/483,923 , "Method and Apparatus for Enhanced Performance of a Conventional Continuous Sterilizing System", filed May 9, 2011.
U.S. Appl. No. 61/488,220 , "Enhanced Product Capacity, Quality and Handling Flexibility Within a Conventional Continuous Food Processing System", filed May 20, 2011.
U.S. Appl. No. 61/540,010 , "Novel Thermal Transfer Media for Processing of Food and Drink Products", filed Sep. 28, 2011.
Ball , "Foundation of Food Process Calculation Methods", Sterilization in Food Technology, 1992, pp. 124-125.
Ball et al., "Heating Curve—Simple Logarithmic Temperature Rise", Sterilization in Food Technology, Theory, Practice and Calculations, 12:313-329.
Berlinet et al., "Effect of Pulp Redaction and Pasteurization on the Release of Aroma Compounds in Industrial Orange Juice", J. Food Sci., vol. 72, No. 8, Oct. 2007, pp. 5535-5543.
Best , "Physical Parameters of Cooling in Cryonics".
Bichier et al., "Thermal Processing of Canned Foods Under Mecheanical Agitation", Asme Heat Transfer Div Publ HTD; American Society of Mechanical Engineers, Heat Transfer in Food Processing, Abstract, 1993.
Browning et al., "Selecting and Maintaining Glycol Based Heat Transfer Fluids", Facilities Engineering Journal, Sep. 2010, pp. 16-18.
Casolari , Food Microbiology, 1994, vol. 11, pp. 75-84.
Chang et al., "Modeling Heat Transfer During Oven Roasting of Unstuffed Turkeys", Journal of Food Science, 1998, 63(2):257-261.
Chang et al., "Heat Transfer and Simulated Sterilization of Particulate Solids in a Continously Flowing System", J. Food Sci., 1989, vol. 54(4):1017-1023 & 1030.
Chen et al., "Modeling Coupled Heat and Mass Transfer for Convection Cooking of Chicken Patties", Journal of Food Engineering, 1999, 42:139-146.
Clausing , "Numerical Methods in Heat Transfer", Lectures on Advanced Heat Transfer, 1989, 157-181.
Conway et al., "Commercial Portion-Controlled Foods in Research Studies: How Accurate are Label Weights", Journal of the American Dietetic Association, vol. 104, No. 9, Sep. 2004.
Datta et al., "Computer-Based Retort Control Logic for On-Line Correction of Process Deviations", J. Food Sci., 1986, 51(2):480-483 & 507.
Denys et al., "Evaluation of Process Deviations, Consisting of Drops in Rotational Speed, During Thermal Processing of Foods in Rotary Water Cascading Retorts", J. Food Eng., 1996, 30:327-338.
Dias et al., "Anhydrous Bioethanol Production Using Bioglycerol: Simulaiton of Extractive Distillation Process", European Symposium on Computer-Aided Process Engineering, 2009, 519-524.
Downing et al., "Canning of Marine Products", A Complete Course in Canning and Related Processes, 1996, Book III; 312-322.
EP12164764.8 , "European Search Report", dated Aug. 16, 2012, 11 pages.
EP12164764.8 , "Office Action", dated Oct. 8, 2013, 5 pages.
EP12164764.8 , "Response to European Search Report", dated Apr. 22, 2013, 42 pages.
EP12164764.8 , "Response to Office Action", dated Feb. 10, 2014, 38 pages.
EP12164859.6 , "European Search Report", dated Aug. 21, 2012, 5 pages.
EP12164859.6 , "Office Action", dated Jul. 19, 2013, 3 pages.
EP12164859.6 , "Response to European Search Report", dated Apr. 22, 2013, 30 pages.
EP12164859.6 , "Response to Office Action", dated Nov. 7, 2013, 48 pages.
EP12165126.9 , "Communication Pursuant to Rule 71(3)", dated Jan. 9, 2014, 31 pages.
EP12165126.9 , "European Search Report", dated Jul. 23, 2012, 8 pages.
EP12165126.9 , "Office Action", dated Aug. 2, 2013, 4 pages.
EP12165126.9 , "Response to European Search Report", dated Jun. 19, 2013, 33 pages.
EP12165126.9 , "Response to Office Action", dated Dec. 9, 2013, 50 pages.
EP12165959.3 , "European Search Report", dated Jul. 24, 2012, 6 pages.
EP12165959.3 , "Response to European Search Report", dated Apr. 26, 2013, 39 pages.
EP12167138.2 , "Decision to Grant", dated Dec. 12, 2013, 2 pages.
EP12167138.2 , "European Search Report", dated Aug. 17, 2012, 6 pages.
EP12167138.2 , "Response to European Search Report", dated May 14, 2013, 49 pages.
EP12168270.2 , "European Search Report", dated Sep. 19, 2012, 4 pages.
EP12168270.2 , "Response to European Search Report", dated May 21, 2013, 63 pages.

(56) References Cited

OTHER PUBLICATIONS

EP12186224.7 , "Communication Under Rule 71(3)", dated Dec. 19, 2013, 29 pages.
EP12186224.7 , "European Search Report", dated Dec. 20, 2012, 6 pages.
EP12186224.7 , "Response to European Search Report", dated Oct. 1, 2013, 34 pages.
Erdogdu et al., "Modeling of Heat Conduction in Elliptical Cross Section: 1 Development and Testing of the Model", Journal of Food Eng., 1998, vol. 38, 223-239.
Fahloul et al., "Measurements and Predictive Modelling of Heat Fluxes in Continuous Baking Ovens", Journal of Food Engineering, 1995, 26:469-479.
Fastag et al., "Variable Control of a Batch Retort and Process Simulation for Optimization Studies", J. of Food Proces Engg., Nov. 1996, 19:1-14.
Fellows , "Food Processing Technology: Principles and Practice, Chapter 12: Heat Sterilisation", second edition, 2000, 262.
Giannoni-Succar et al., "Correction Factor of Deviant Thermal Processes Applied to Packaged Heat Conduction Food", J. Food Sci, 1982, 47(2):642-646.
Gill et al., "Simulation of Ethanol Extractive Distilation with a Glycols Mixture as Entrainer", 2nd Mercosur Congress on Chemical Engineering, 2005.
Gill et al., "Computerized Control Strategies for a Steam Retort", Journal of Food Engineering, 1989, vol. 10 135-154.
Glycerine NPL , "http://www.engineeringtoolbox.com/glycerine-boiling-freezing-points-d_1590. html, 2011".
Hayakawa et al., "Estimating Heat Processes in Canned Foods", Ashrae Journal, Sep. 1975, 36-37.
http://www.artisanind.com/ps/equ , "The Artisan Rototherm", Artisan Industries Inc., Available at least as early as May 8, 2012.
http://www.sciencemadness.org/ta , "(comments by Sauron on pp. 4-5)", Jan. 19, 2007.
Huang et al., "Meatball Cooking—Modeling and Simulation", Journal of Food Engineering, 1995, 24:87-100.
Jiang et al., "Desilication from Illite by Thermochemical Activation", Oct. 2004, vol. 14, No. 5, 1000-1005.
Lanoiselle et al., "Predicting Internal Temperature of Canned Foods During Thermal Processing Using a Linear Recursive Model", J. Food Sci., 1995, 60(4):833-840.
Larkin et al., "Experimental Errors Associated with the Estimation of Thermal Diffusivity from Thermal Process Data", J. Food Sci, 1987, 52(2):419-428.
Liu , "Modelling of Thermal Properties of Food", Handbook of Food Science, Technology and Engineering, 2006, vol. 3 Chapter 110.
Manson , "Evaluating Complex Deviations—Hydrostatic Sterilizers", TechniCAL, Inc., Chapter 12:12-1-12.4.
Manson , "Evaluation of Lethality and Nutrient Retentions of Conduction—Heating Foods in Rectangular Containers", Food Technology, 1970, 24(11):109-113.
Martin et al., "Propylene Glycol Based Heat Transfer Fluids", http://www.engineeringtoolbox.com/propylene-glycol-d_363.html, 2011.
McConnell , "Effect of a Drop in Retort Temperature Upon the Lethality of Processes for Convection Heating Products", Food Tech., Feb. 1952, vol. 6, No. 2, 76-78.
Meng et al., "Heat Transfer to Canned Particulates in High-Viscosity Newtonian Fluids During Agitation Processing", J. Food Processing and Preservation, 2006, 30:643-658.
Morrison et al., "Glycerol", Dec. 4, 2000, 1-13.
Navankasattusas et al., "Monitoring and Controlling Thermal Processes by On-Line Measurement of Accomplished Lethality", Food Technology, Mar. 1978, 79-83.
Onita et al., "Estimation of the Specific Heat and Thermal Conductivity of Foods Only by Their Classes of Substances Contents (Water, Proteins, Fats, Carbohydrates, Fibers and Ash", Scientifical Researches. Agroalimentary Processes and Technologies, vol. 11, No. 1, 2005, pp. 217-222.
Porter et al., "Non-Newtonian Viscosity of Polymers", J. Appl. Phys., 1961, vol. 32, No. 11, 2326.
Press et al., "Parabolic Interpolation and Brent's Method in One Dimension", Numerical Recipes in Fortran, 395-398.
Rainbow et al., "Effect of Chelating Agents on Accumulation of Cadmium by the Barnacle Semibalanus Balanoides and Complexation of Soluble Cadmium, Zinc and Copper", Marine Ecology 2, 1980, 143-152.
Sahin et al., "The Thermal Properties of Food", Springer Science, Physical Properties of Food, 2006, 107-155.
Simpson et al., "Computer Control of Batch Retort Process Operations", Food Processing Automation, Conference (Proceedings), May 1990.
Teixeira et al., "Computer Control of Batch Retort Operations with On-Line Correction of Process Deviations", Food Technology, Apr. 1982, 85-90.
Teixeira et al., "Computer Optimization of Nutrient Retention in the Thermal Processing of Conduction-Heated Foods", Food Technology, 1969, vol. 23(845):137-142.
Teixeira , "Innovative Heat Transfer Models: From Research Lab to On-Line Implementation", Food Processing Automation II, Proceedings of the 1992 FPEI Conference, May 4-6, 1992, 177-184.
Teixeira et al., "On-Line Retort Control in Thermal Sterilization of Canned Foods", Food Control, 1997, vol. 8 No. 1:13-20.
Thin-Film Drying , LCI Corporation, Available at least as early as May 8, 2012.
Wang et al., "A Mathematical Model of Simultaneous Heat and Moisture Transfer During Drying of Potato", Journal of Food Engineering, 1995, 24:47-60.
Weng et al., "Process Deviation Analysis of Conduction-Heating Canned Foods Processed in a Hydrostatic Sterilizer Using a Mathematical Model", Journal Food Processing Automation IV, 1995, vol. 41(6):368-379.
Weng et al., "The Use of a Time-Temperature-Integrator in Conjunction with Mathematical Modelling for Determining Liquid/Particle Heat Transfer Coefficients", J. Food Engg., 1992, 16:197-214.
Williams , "Modular Sterilization Processing", Allpax Products, Inc.
www.lytron.com/tools-and-technic , "The Best Heat Transfer Fluids for Liquid Cooling", Jul. 14, 2011.
Young et al., "Product Temperature Prediction in Hydrostatic Retorts", Transactions of the ASAE, 1983, vol. 26(1):316-320.
Young et al., "Predicting Product Lethality in Hydrostatic Retorts", Journal of Food Science, 1985, vol. 50:1467-1472.
Zhao et al., "Computer Simulation on Onboard Chilling and Freezing of Albacore Tuna", Journal of Food Science, 1998, vol. 63(5):751-755.
Final Office Action, U.S. Appl. No. 13/464,997, dated May 23, 2014.
Response to Non-Final Office Action, U.S. Appl. No. 13/452,207, filed Jun. 5, 2014.
Decision to Grant, European Patent Application No. 12186224.7, dated Mar. 27, 2014.

* cited by examiner

Figure 1 - Basic Design of 2-chamber packaging container for food and drink pasteurization and sterilization
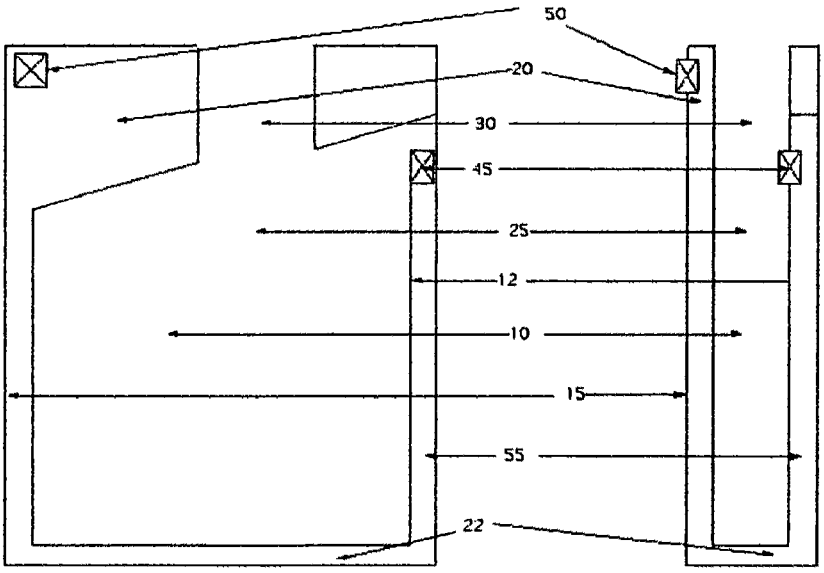

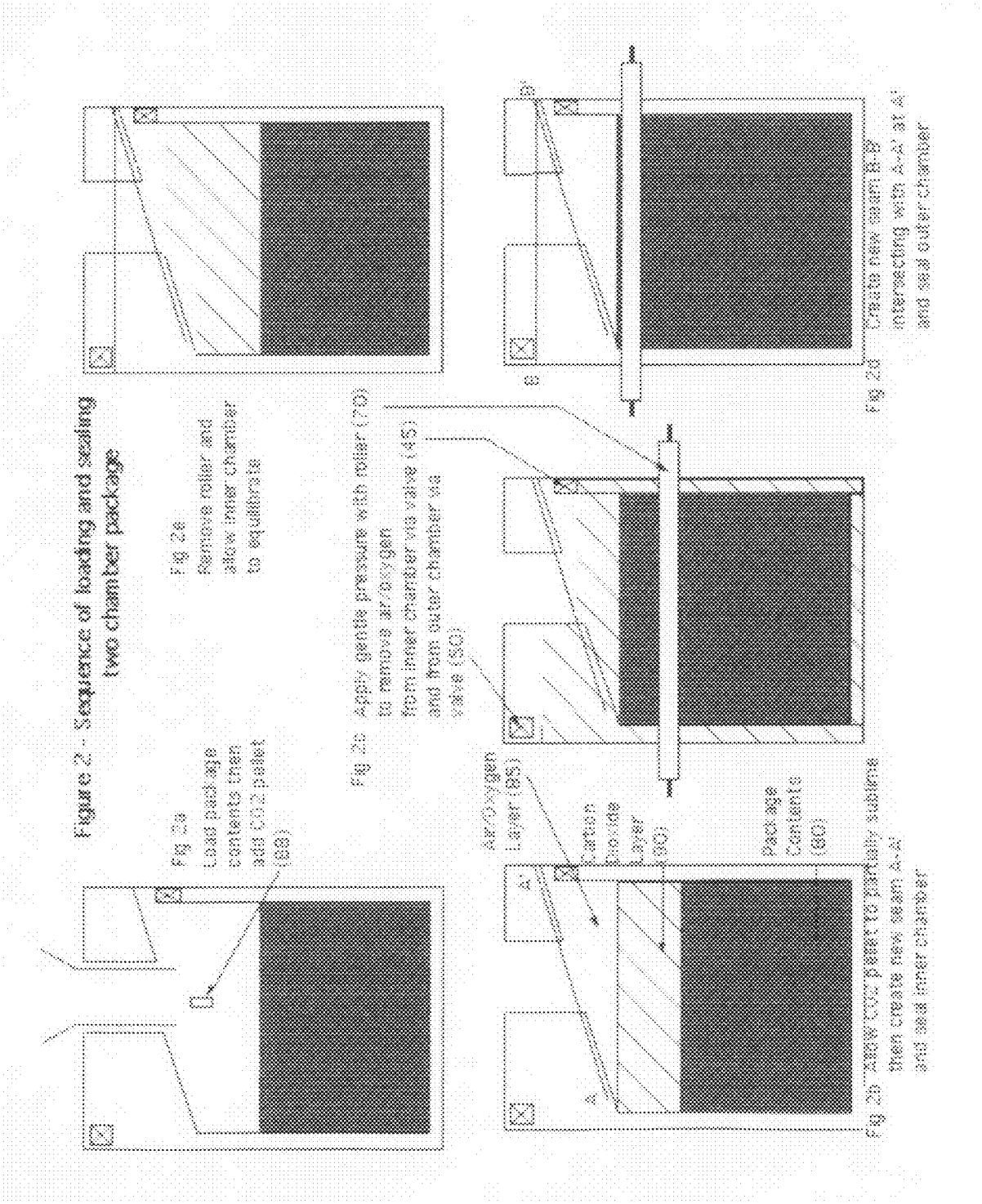
Figure 2 - Sequence of loading and sealing two chamber package
Fig 2a
Load package contents then add CO2 pellet
(80)
Fig 2b
Remove roller and allow inner chamber to equilibrate
Fig 2c
Apply roller pressure and then create vacuum and flush
(70)
Fig 2d
Air attached roller unclamp and release
(50)
Fig 2e
Cut seal
(55)
Fig 2f
Cut seal parallel to partially sealed edge and inner chamber
Fig 2g
Cut seal perpendicular to partially sealed edge and inner chamber
Fig 2h
Cut seal parallel to partially sealed edge and outer chamber
Fig 2i
Cut seal perpendicular to partially sealed edge and outer chamber
Fig 2j
Cut seal parallel to partially sealed edge and outer chamber
Fig 2k
Cut seal perpendicular to partially sealed edge and outer chamber
Fig 2l
Cut seal parallel to partially sealed edge and outer chamber
Fig 2m
Cut seal perpendicular to partially sealed edge and outer chamber
Fig 2n
Cut seal parallel to partially sealed edge and outer chamber
Fig 2o
Cut seal perpendicular to partially sealed edge and outer chamber
Fig 2p
Cut seal parallel to partially sealed edge and outer chamber
Fig 2q
Cut seal perpendicular to partially sealed edge and outer chamber
Fig 2r
Cut seal parallel to partially sealed edge and outer chamber
Fig 2s
Cut seal perpendicular to partially sealed edge and outer chamber
Fig 2t
Cut seal parallel to partially sealed edge and outer chamber
Fig 2u
Cut seal perpendicular to partially sealed edge and outer chamber
Fig 2v
Cut seal parallel to partially sealed edge and outer chamber
Fig 2w
Cut seal perpendicular to partially sealed edge and outer chamber
Fig 2x
Cut seal parallel to partially sealed edge and outer chamber
Fig 2y
Cut seal perpendicular to partially sealed edge and outer chamber
Fig 2z
Cut seal parallel to partially sealed edge and outer chamber
Fig 2aa
Cut seal perpendicular to partially sealed edge and outer chamber
Fig 2ab
Cut seal parallel to partially sealed edge and outer chamber
Fig 2ac
Cut seal perpendicular to partially sealed edge and outer chamber
Fig 2ad
Cut seal parallel to partially sealed edge and outer chamber
Fig 2ae
Cut seal perpendicular to partially sealed edge and outer chamber
Fig 2af
Cut seal parallel to partially sealed edge and outer chamber
Fig 2ag
Cut seal perpendicular to partially sealed edge and outer chamber
Fig 2ah
Cut seal parallel to partially sealed edge and outer chamber
Fig 2ai
Cut seal perpendicular to partially sealed edge and outer chamber
Fig 2aj
Cut seal parallel to partially sealed edge and outer chamber
Fig 2ak
Cut seal perpendicular to partially sealed edge and outer chamber
Fig 2al
Cut seal parallel to partially sealed edge and outer chamber
Fig 2am
Cut seal perpendicular to partially sealed edge and outer chamber
Fig 2an
Cut seal parallel to partially sealed edge and outer chamber
Fig 2ao
Cut seal perpendicular to partially sealed edge and outer chamber
Fig 2ap
Cut seal parallel to partially sealed edge and outer chamber
Fig 2aq
Cut seal perpendicular to partially sealed edge and outer chamber
Fig 2ar
Cut seal parallel to partially sealed edge and outer chamber
Fig 2as
Cut seal perpendicular to partially sealed edge and outer chamber
Fig 2at
Cut seal parallel to partially sealed edge and outer chamber
Fig 2au
Cut seal perpendicular to partially sealed edge and outer chamber
Fig 2av
Cut seal parallel to partially sealed edge and outer chamber
Fig 2aw
Cut seal perpendicular to partially sealed edge and outer chamber
Fig 2ax
Cut seal parallel to partially sealed edge and outer chamber
Fig 2ay
Cut seal perpendicular to partially sealed edge and outer chamber
Fig 2az
Cut seal parallel to partially sealed edge and outer chamber
Fig 2ba
Cut seal perpendicular to partially sealed edge and outer chamber
Fig 2bb
Cut seal parallel to partially sealed edge and outer chamber
Fig 2bc
Cut seal perpendicular to partially sealed edge and outer chamber
Fig 2bd
Cut seal parallel to partially sealed edge and outer chamber
Fig 2be
Cut seal perpendicular to partially sealed edge and outer chamber
Fig 2bf
Cut seal parallel to partially sealed edge and outer chamber
Fig 2bg
Cut seal perpendicular to partially sealed edge and outer chamber
Fig 2bh
Cut seal parallel to partially sealed edge and outer chamber
Fig 2bi
Cut seal perpendicular to partially sealed edge and outer chamber
Fig 2bj
Cut seal parallel to partially sealed edge and outer chamber
Fig 2bk
Cut seal perpendicular to partially sealed edge and outer chamber
Fig 2bl
Cut seal parallel to partially sealed edge and outer chamber
Fig 2bm
Cut seal perpendicular to partially sealed edge and outer chamber
Fig 2bn
Cut seal parallel to partially sealed edge and outer chamber
Fig 2bo
Cut seal perpendicular to partially sealed edge and outer chamber
Fig 2bp
Cut seal parallel to partially sealed edge and outer chamber
Fig 2bq
Cut seal perpendicular to partially sealed edge and outer chamber
Fig 2br
Cut seal parallel to partially sealed edge and outer chamber
Fig 2bs
Cut seal perpendicular to partially sealed edge and outer chamber
Fig 2bt
Cut seal parallel to partially sealed edge and outer chamber
Fig 2bu
Cut seal perpendicular to partially sealed edge and outer chamber
Fig 2bv
Cut seal parallel to partially sealed edge and outer chamber
Fig 2bw
Cut seal perpendicular to partially sealed edge and outer chamber
Fig 2bx
Cut seal parallel to partially sealed edge and outer chamber
Fig 2by
Cut seal perpendicular to partially sealed edge and outer chamber
Fig 2bz
Cut seal parallel to partially sealed edge and outer chamber
Fig 2ca
Cut seal perpendicular to partially sealed edge and outer chamber
Fig 2cb
Cut seal parallel to partially sealed edge and outer chamber
Fig 2cc
Cut seal perpendicular to partially sealed edge and outer chamber
Fig 2cd
Cut seal parallel to partially sealed edge and outer chamber
Fig 2ce
Cut seal perpendicular to partially sealed edge and outer chamber
Fig 2cf
Cut seal parallel to partially sealed edge and outer chamber
Fig 2cg
Cut seal perpendicular to partially sealed edge and outer chamber
Fig 2ch
Cut seal parallel to partially sealed edge and outer chamber
Fig 2ci
Cut seal perpendicular to partially sealed edge and outer chamber
Fig 2cj
Cut seal parallel to partially sealed edge and outer chamber
Fig 2ck
Cut seal perpendicular to partially sealed edge and outer chamber
Fig 2cl
Cut seal parallel to partially sealed edge and outer chamber
Fig 2cm
Cut seal perpendicular to partially sealed edge and outer chamber
Fig 2cn
Cut seal parallel to partially sealed edge and outer chamber
Fig 2co
Cut seal perpendicular to partially sealed edge and outer chamber
Fig 2cp
Cut seal parallel to partially sealed edge and outer chamber
Fig 2cq
Cut seal perpendicular to partially sealed edge and outer chamber
Fig 2cr
Cut seal parallel to partially sealed edge and outer chamber
Fig 2cs
Cut seal perpendicular to partially sealed edge and outer chamber
Fig 2ct
Cut seal parallel to partially sealed edge and outer chamber
Fig 2cu
Cut seal perpendicular to partially sealed edge and outer chamber
Fig 2cv
Cut seal parallel to partially sealed edge and outer chamber
Fig 2cw
Cut seal perpendicular to partially sealed edge and outer chamber
Fig 2cx
Cut seal parallel to partially sealed edge and outer chamber
Fig 2cy
Cut seal perpendicular to partially sealed edge and outer chamber
Fig 2cz
Cut seal parallel to partially sealed edge and outer chamber
Fig 2da
Cut seal perpendicular to partially sealed edge and outer chamber
Fig 2db
Cut seal parallel to partially sealed edge and outer chamber
Fig 2dc
Cut seal perpendicular to partially sealed edge and outer chamber
Fig 2dd
Cut seal parallel to partially sealed edge and outer chamber
Fig 2de
Cut seal perpendicular to partially sealed edge and outer chamber
Fig 2df
Cut seal parallel to partially sealed edge and outer chamber
Fig 2dg
Cut seal perpendicular to partially sealed edge and outer chamber
Fig 2dh
Cut seal parallel to partially sealed edge and outer chamber
Fig 2di
Cut seal perpendicular to partially sealed edge and outer chamber
Fig 2dj
Cut seal parallel to partially sealed edge and outer chamber
Fig 2dk
Cut seal perpendicular to partially sealed edge and outer chamber
Fig 2dl
Cut seal parallel to partially sealed edge and outer chamber
Fig 2dm
Cut seal perpendicular to partially sealed edge and outer chamber
Fig 2dn
Cut seal parallel to partially sealed edge and outer chamber
Fig 2do
Cut seal perpendicular to partially sealed edge and outer chamber
Fig 2dp
Cut seal parallel to partially sealed edge and outer chamber
Fig 2dq
Cut seal perpendicular to partially sealed edge and outer chamber
Fig 2dr
Cut seal parallel to partially sealed edge and outer chamber
Fig 2ds
Cut seal perpendicular to partially sealed edge and outer chamber
Fig 2dt
Cut seal parallel to partially sealed edge and outer chamber
Fig 2du
Cut seal perpendicular to partially sealed edge and outer chamber
Fig 2dv
Cut seal parallel to partially sealed edge and outer chamber
Fig 2dw
Cut seal perpendicular to partially sealed edge and outer chamber
Fig 2dx
Cut seal parallel to partially sealed edge and outer chamber
Fig 2dy
Cut seal perpendicular to partially sealed edge and outer chamber
Fig 2dz
Cut seal parallel to partially sealed edge and outer chamber
Fig 2ea
Cut seal perpendicular to partially sealed edge and outer chamber
Fig 2eb
Cut seal parallel to partially sealed edge and outer chamber
Fig 2ec
Cut seal perpendicular to partially sealed edge and outer chamber
Fig 2ed
Cut seal parallel to partially sealed edge and outer chamber
Fig 2ee
Cut seal perpendicular to partially sealed edge and outer chamber
Fig 2ef
Cut seal parallel to partially sealed edge and outer chamber
Fig 2eg
Cut seal perpendicular to partially sealed edge and outer chamber
Fig 2eh
Cut seal parallel to partially sealed edge and outer chamber
Fig 2ei
Cut seal perpendicular to partially sealed edge and outer chamber
Fig 2ej
Cut seal parallel to partially sealed edge and outer chamber
Fig 2ek
Cut seal perpendicular to partially sealed edge and outer chamber
Fig 2el
Cut seal parallel to partially sealed edge and outer chamber
Fig 2em
Cut seal perpendicular to partially sealed edge and outer chamber
Fig 2en
Cut seal parallel to partially sealed edge and outer chamber
Fig 2eo
Cut seal perpendicular to partially sealed edge and outer chamber
Fig 2ep
Cut seal parallel to partially sealed edge and outer chamber
Fig 2eq
Cut seal perpendicular to partially sealed edge and outer chamber
Fig 2er
Cut seal parallel to partially sealed edge and outer chamber
Fig 2es
Cut seal perpendicular to partially sealed edge and outer chamber
Fig 2et
Cut seal parallel to partially sealed edge and outer chamber
Fig 2eu
Cut seal perpendicular to partially sealed edge and outer chamber
Fig 2ev
Cut seal parallel to partially sealed edge and outer chamber
Fig 2ew
Cut seal perpendicular to partially sealed edge and outer chamber
Fig 2ex
Cut seal parallel to partially sealed edge and outer chamber
Fig 2ey
Cut seal perpendicular to partially sealed edge and outer chamber
Fig 2ez
Cut seal parallel to partially sealed edge and outer chamber
Fig 2fa
Cut seal perpendicular to partially sealed edge and outer chamber
Fig 2fb
Cut seal parallel to partially sealed edge and outer chamber
Fig 2fc
Cut seal perpendicular to partially sealed edge and outer chamber
Fig 2fd
Cut seal parallel to partially sealed edge and outer chamber
Fig 2fe
Cut seal perpendicular to partially sealed edge and outer chamber
Fig 2ff
Cut seal parallel to partially sealed edge and outer chamber
Fig 2fg
Cut seal perpendicular to partially sealed edge and outer chamber
Fig 2fh
Cut seal parallel to partially sealed edge and outer chamber
Fig 2fi
Cut seal perpendicular to partially sealed edge and outer chamber
Fig 2fj
Cut seal parallel to partially sealed edge and outer chamber
Fig 2fk
Cut seal perpendicular to partially sealed edge and outer chamber
Fig 2fl
Cut seal parallel to partially sealed edge and outer chamber
Fig 2fm
Cut seal perpendicular to partially sealed edge and outer chamber
Fig 2fn
Cut seal parallel to partially sealed edge and outer chamber
Fig 2fo
Cut seal perpendicular to partially sealed edge and outer chamber
Fig 2fp
Cut seal parallel to partially sealed edge and outer chamber
Fig 2fq
Cut seal perpendicular to partially sealed edge and outer chamber
Fig 2fr
Cut seal parallel to partially sealed edge and outer chamber
Fig 2fs
Cut seal perpendicular to partially sealed edge and outer chamber
Fig 2ft
Cut seal parallel to partially sealed edge and outer chamber
Fig 2fu
Cut seal perpendicular to partially sealed edge and outer chamber
Fig 2fv
Cut seal parallel to partially sealed edge and outer chamber
Fig 2fw
Cut seal perpendicular to partially sealed edge and outer chamber
Fig 2fx
Cut seal parallel to partially sealed edge and outer chamber
Fig 2fy
Cut seal perpendicular to partially sealed edge and outer chamber
Fig 2fz
Cut seal parallel to partially sealed edge and outer chamber
Fig 2ga
Cut seal perpendicular to partially sealed edge and outer chamber
Fig 2gb
Cut seal parallel to partially sealed edge and outer chamber
Fig 2gc
Cut seal perpendicular to partially sealed edge and outer chamber
Fig 2gd
Cut seal parallel to partially sealed edge and outer chamber
Fig 2ge
Cut seal perpendicular to partially sealed edge and outer chamber
Fig 2gf
Cut seal parallel to partially sealed edge and outer chamber
Fig 2gg
Cut seal perpendicular to partially sealed edge and outer chamber
Fig 2gh
Cut seal parallel to partially sealed edge and outer chamber
Fig 2gi
Cut seal perpendicular to partially sealed edge and outer chamber
Fig 2gj
Cut seal parallel to partially sealed edge and outer chamber
Fig 2gk
Cut seal perpendicular to partially sealed edge and outer chamber
Fig 2gl
Cut seal parallel to partially sealed edge and outer chamber
Fig 2gm
Cut seal perpendicular to partially sealed edge and outer chamber
Fig 2gn
Cut seal parallel to partially sealed edge and outer chamber
Fig 2go
Cut seal perpendicular to partially sealed edge and outer chamber
Fig 2gp
Cut seal parallel to partially sealed edge and outer chamber
Fig 2gq
Cut seal perpendicular to partially sealed edge and outer chamber
Fig 2gr
Cut seal parallel to partially sealed edge and outer chamber
Fig 2gs
Cut seal perpendicular to partially sealed edge and outer chamber
Fig 2gt
Cut seal parallel to partially sealed edge and outer chamber
Fig 2gu
Cut seal perpendicular to partially sealed edge and outer chamber
Fig 2gv
Cut seal parallel to partially sealed edge and outer chamber
Fig 2gw
Cut seal perpendicular to partially sealed edge and outer chamber
Fig 2gx
Cut seal parallel to partially sealed edge and outer chamber
Fig 2gy
Cut seal perpendicular to partially sealed edge and outer chamber
Fig 2gz
Cut seal parallel to partially sealed edge and outer chamber
Fig 2ha
Cut seal perpendicular to partially sealed edge and outer chamber
Fig 2hb
Cut seal parallel to partially sealed edge and outer chamber
Fig 2hc
Cut seal perpendicular to partially sealed edge and outer chamber
Fig 2hd
Cut seal parallel to partially sealed edge and outer chamber
Fig 2he
Cut seal perpendicular to partially sealed edge and outer chamber
Fig 2hf
Cut seal parallel to partially sealed edge and outer chamber
Fig 2hg
Cut seal perpendicular to partially sealed edge and outer chamber
Fig 2hh
Cut seal parallel to partially sealed edge and outer chamber
Fig 2hi
Cut seal perpendicular to partially sealed edge and outer chamber
Fig 2hj
Cut seal parallel to partially sealed edge and outer chamber
Fig 2hk
Cut seal perpendicular to partially sealed edge and outer chamber
Fig 2hl
Cut seal parallel to partially sealed edge and outer chamber
Fig 2hm
Cut seal perpendicular to partially sealed edge and outer chamber
Fig 2hn
Cut seal parallel to partially sealed edge and outer chamber
Fig 2ho
Cut seal perpendicular to partially sealed edge and outer chamber
Fig 2hp
Cut seal parallel to partially sealed edge and outer chamber
Fig 2hq
Cut seal perpendicular to partially sealed edge and outer chamber
Fig 2hr
Cut seal parallel to partially sealed edge and outer chamber
Fig 2hs
Cut seal perpendicular to partially sealed edge and outer chamber
Fig 2ht
Cut seal parallel to partially sealed edge and outer chamber
Fig 2hu
Cut seal perpendicular to partially sealed edge and outer chamber
Fig 2hv
Cut seal parallel to partially sealed edge and outer chamber
Fig 2hw
Cut seal perpendicular to partially sealed edge and outer chamber
Fig 2hx
Cut seal parallel to partially sealed edge and outer chamber
Fig 2hy
Cut seal perpendicular to partially sealed edge and outer chamber
Fig 2hz
Cut seal parallel to partially sealed edge and outer chamber
Fig 2ia
Cut seal perpendicular to partially sealed edge and outer chamber
Fig 2ib
Cut seal parallel to partially sealed edge and outer chamber
Fig 2ic
Cut seal perpendicular to partially sealed edge and outer chamber
Fig 2id
Cut seal parallel to partially sealed edge and outer chamber
Fig 2ie
Cut seal perpendicular to partially sealed edge and outer chamber
Fig 2if
Cut seal parallel to partially sealed edge and outer chamber
Fig 2ig
Cut seal perpendicular to partially sealed edge and outer chamber
Fig 2ih
Cut seal parallel to partially sealed edge and outer chamber
Fig 2ii
Cut seal perpendicular to partially sealed edge and outer chamber
Fig 2ij
Cut seal parallel to partially sealed edge and outer chamber
Fig 2ik
Cut seal perpendicular to partially sealed edge and outer chamber
Fig 2il
Cut seal parallel to partially sealed edge and outer chamber
Fig 2im
Cut seal perpendicular to partially sealed edge and outer chamber
Fig 2in
Cut seal parallel to partially sealed edge and outer chamber
Fig 2io
Cut seal perpendicular to partially sealed edge and outer chamber
Fig 2ip
Cut seal parallel to partially sealed edge and outer chamber
Fig 2iq
Cut seal perpendicular to partially sealed edge and outer chamber
Fig 2ir
Cut seal parallel to partially sealed edge and outer chamber
Fig 2is
Cut seal perpendicular to partially sealed edge and outer chamber
Fig 2it
Cut seal parallel to partially sealed edge and outer chamber
Fig 2iu
Cut seal perpendicular to partially sealed edge and outer chamber
Fig 2iv
Cut seal parallel to partially sealed edge and outer chamber
Fig 2iw
Cut seal perpendicular to partially sealed edge and outer chamber
Fig 2ix
Cut seal parallel to partially sealed edge and outer chamber
Fig 2iy
Cut seal perpendicular to partially sealed edge and outer chamber
Fig 2iz
Cut seal parallel to partially sealed edge and outer chamber
Fig 2ja
Cut seal perpendicular to partially sealed edge and outer chamber
Fig 2jb
Cut seal parallel to partially sealed edge and outer chamber
Fig 2jc
Cut seal perpendicular to partially sealed edge and outer chamber
Fig 2jd
Cut seal parallel to partially sealed edge and outer chamber
Fig 2je
Cut seal perpendicular to partially sealed edge and outer chamber
Fig 2jf
Cut seal parallel to partially sealed edge and outer chamber
Fig 2jg
Cut seal perpendicular to partially sealed edge and outer chamber
Fig 2jh
Cut seal parallel to partially sealed edge and outer chamber
Fig 2ji
Cut seal perpendicular to partially sealed edge and outer chamber
Fig 2jj
Cut seal parallel to partially sealed edge and outer chamber
Fig 2jk
Cut seal perpendicular to partially sealed edge and outer chamber
Fig 2jl
Cut seal parallel to partially sealed edge and outer chamber
Fig 2jm
Cut seal perpendicular to partially sealed edge and outer chamber
Fig 2jn
Cut seal parallel to partially sealed edge and outer chamber
Fig 2jo
Cut seal perpendicular to partially sealed edge and outer chamber
Fig 2jp
Cut seal parallel to partially sealed edge and outer chamber
Fig 2jq
Cut seal perpendicular to partially sealed edge and outer chamber
Fig 2jr
Cut seal parallel to partially sealed edge and outer chamber
Fig 2js
Cut seal perpendicular to partially sealed edge and outer chamber
Fig 2jt
Cut seal parallel to partially sealed edge and outer chamber
Fig 2ju
Cut seal perpendicular to partially sealed edge and outer chamber
Fig 2jv
Cut seal parallel to partially sealed edge and outer chamber
Fig 2jw
Cut seal perpendicular to partially sealed edge and outer chamber
Fig 2jx
Cut seal parallel to partially sealed edge and outer chamber
Fig 2jy
Cut seal perpendicular to partially sealed edge and outer chamber
Fig 2jz
Cut seal parallel to partially sealed edge and outer chamber
Fig 2ka
Cut seal perpendicular to partially sealed edge and outer chamber
Fig 2kb
Cut seal parallel to partially sealed edge and outer chamber
Fig 2kc
Cut seal perpendicular to partially sealed edge and outer chamber
Fig 2kd
Cut seal parallel to partially sealed edge and outer chamber
Fig 2ke
Cut seal perpendicular to partially sealed edge and outer chamber
Fig 2kf
Cut seal parallel to partially sealed edge and outer chamber
Fig 2kg
Cut seal perpendicular to partially sealed edge and outer chamber
Fig 2kh
Cut seal parallel to partially sealed edge and outer chamber
Fig 2ki
Cut seal perpendicular to partially sealed edge and outer chamber
Fig 2kj
Cut seal parallel to partially sealed edge and outer chamber
Fig 2kk
Cut seal perpendicular to partially sealed edge and outer chamber
Fig 2kl
Cut seal parallel to partially sealed edge and outer chamber
Fig 2km
Cut seal perpendicular to partially sealed edge and outer chamber
Fig 2kn
Cut seal parallel to partially sealed edge and outer chamber
Fig 2ko
Cut seal perpendicular to partially sealed edge and outer chamber
Fig 2kp
Cut seal parallel to partially sealed edge and outer chamber
Fig 2kq
Cut seal perpendicular to partially sealed edge and outer chamber
Fig 2kr
Cut seal parallel to partially sealed edge and outer chamber
Fig 2ks
Cut seal perpendicular to partially sealed edge and outer chamber
Fig 2kt
Cut seal parallel to partially sealed edge and outer chamber
Fig 2ku
Cut seal perpendicular to partially sealed edge and outer chamber
Fig 2kv
Cut seal parallel to partially sealed edge and outer chamber
Fig 2kw
Cut seal perpendicular to partially sealed edge and outer chamber
Fig 2kx
Cut seal parallel to partially sealed edge and outer chamber
Fig 2ky
Cut seal perpendicular to partially sealed edge and outer chamber
Fig 2kz
Cut seal parallel to partially sealed edge and outer chamber
Fig 2la
Cut seal perpendicular to partially sealed edge and outer chamber
Fig 2lb
Cut seal parallel to partially sealed edge and outer chamber
Fig 2lc
Cut seal perpendicular to partially sealed edge and outer chamber
Fig 2ld
Cut seal parallel to partially sealed edge and outer chamber
Fig 2le
Cut seal perpendicular to partially sealed edge and outer chamber
Fig 2lf
Cut seal parallel to partially sealed edge and outer chamber
Fig 2lg
Cut seal perpendicular to partially sealed edge and outer chamber
Fig 2lh
Cut seal parallel to partially sealed edge and outer chamber
Fig 2li
Cut seal perpendicular to partially sealed edge and outer chamber
Fig 2lj
Cut seal parallel to partially sealed edge and outer chamber
Fig 2lk
Cut seal perpendicular to partially sealed edge and outer chamber
Fig 2ll
Cut seal parallel to partially sealed edge and outer chamber
Fig 2lm
Cut seal perpendicular to partially sealed edge and outer chamber
Fig 2ln
Cut seal parallel to partially sealed edge and outer chamber
Fig 2lo
Cut seal perpendicular to partially sealed edge and outer chamber
Fig 2lp
Cut seal parallel to partially sealed edge and outer chamber
Fig 2lq
Cut seal perpendicular to partially sealed edge and outer chamber
Fig 2lr
Cut seal parallel to partially sealed edge and outer chamber
Fig 2ls
Cut seal perpendicular to partially sealed edge and outer chamber
Fig 2lt
Cut seal parallel to partially sealed edge and outer chamber
Fig 2lu
Cut seal perpendicular to partially sealed edge and outer chamber
Fig 2lv
Cut seal parallel to partially sealed edge and outer chamber
Fig 2lw
Cut seal perpendicular to partially sealed edge and outer chamber
Fig 2lx
Cut seal parallel to partially sealed edge and outer chamber
Fig 2ly
Cut seal perpendicular to partially sealed edge and outer chamber
Fig 2lz
Cut seal parallel to partially sealed edge and outer chamber
Fig 2ma
Cut seal perpendicular to partially sealed edge and outer chamber
Fig 2mb
Cut seal parallel to partially sealed edge and outer chamber
Fig 2mc
Cut seal perpendicular to partially sealed edge and outer chamber
Fig 2md
Cut seal parallel to partially sealed edge and outer chamber
Fig 2me
Cut seal perpendicular to partially sealed edge and outer chamber
Fig 2mf
Cut seal parallel to partially sealed edge and outer chamber
Fig 2mg
Cut seal perpendicular to partially sealed edge and outer chamber
Fig 2mh
Cut seal parallel to partially sealed edge and outer chamber
Fig 2mi
Cut seal perpendicular to partially sealed edge and outer chamber
Fig 2mj
Cut seal parallel to partially sealed edge and outer chamber
Fig 2mk
Cut seal perpendicular to partially sealed edge and outer chamber
Fig 2ml
Cut seal parallel to partially sealed edge and outer chamber
Fig 2mm
Cut seal perpendicular to partially sealed edge and outer chamber
Fig 2mn
Cut seal parallel to partially sealed edge and outer chamber
Fig 2mo
Cut seal perpendicular to partially sealed edge and outer chamber
Fig 2mp
Cut seal parallel to partially sealed edge and outer chamber
Fig 2mq
Cut seal perpendicular to partially sealed edge and outer chamber
Fig 2mr
Cut seal parallel to partially sealed edge and outer chamber
Fig 2ms
Cut seal perpendicular to partially sealed edge and outer chamber
Fig 2mt
Cut seal parallel to partially sealed edge and outer chamber
Fig 2mu
Cut seal perpendicular to partially sealed edge and outer chamber
Fig 2mv
Cut seal parallel to partially sealed edge and outer chamber
Fig 2mw
Cut seal perpendicular to partially sealed edge and outer chamber
Fig 2mx
Cut seal parallel to partially sealed edge and outer chamber
Fig 2my
Cut seal perpendicular to partially sealed edge and outer chamber
Fig 2mz
Cut seal parallel to partially sealed edge and outer chamber
Fig 2na
Cut seal perpendicular to partially sealed edge and outer chamber
Fig 2nb
Cut seal parallel to partially sealed edge and outer chamber
Fig 2nc
Cut seal perpendicular to partially sealed edge and outer chamber
Fig 2nd
Cut seal parallel to partially sealed edge and outer chamber
Fig 2ne
Cut seal perpendicular to partially sealed edge and outer chamber
Fig 2nf
Cut seal parallel to partially sealed edge and outer chamber
Fig 2ng
Cut seal perpendicular to partially sealed edge and outer chamber
Fig 2nh
Cut seal parallel to partially sealed edge and outer chamber
Fig 2ni
Cut seal perpendicular to partially sealed edge and outer chamber
Fig 2nj
Cut seal parallel to partially sealed edge and outer chamber
Fig 2nk
Cut seal perpendicular to partially sealed edge and outer chamber
Fig 2nl
Cut seal parallel to partially sealed edge and outer chamber
Fig 2nm
Cut seal perpendicular to partially sealed edge and outer chamber
Fig 2nn
Cut seal parallel to partially sealed edge and outer chamber
Fig 2no
Cut seal perpendicular to partially sealed edge and outer chamber
Fig 2np
Cut seal parallel to partially sealed edge and outer chamber
Fig 2nq
Cut seal perpendicular to partially sealed edge and outer chamber
Fig 2nr
Cut seal parallel to partially sealed edge and outer chamber
Fig 2ns
Cut seal perpendicular to partially sealed edge and outer chamber
Fig 2nt
Cut seal parallel to partially sealed edge and outer chamber
Fig 2nu
Cut seal perpendicular to partially sealed edge and outer chamber
Fig 2nv
Cut seal parallel to partially sealed edge and outer chamber
Fig 2nw
Cut seal perpendicular to partially sealed edge and outer chamber
Fig 2nx
Cut seal parallel to partially sealed edge and outer chamber
Fig 2ny
Cut seal perpendicular to partially sealed edge and outer chamber
Fig 2nz
Cut seal parallel to partially sealed edge and outer chamber
Fig 2oa
Cut seal perpendicular to partially sealed edge and outer chamber
Fig 2ob
Cut seal parallel to partially sealed edge and outer chamber
Fig 2oc
Cut seal perpendicular to partially sealed edge and outer chamber
Fig 2od
Cut seal parallel to partially sealed edge and outer chamber
Fig 2oe
Cut seal perpendicular to partially sealed edge and outer chamber
Fig 2of
Cut seal parallel to partially sealed edge and outer chamber
Fig 2og
Cut seal perpendicular to partially sealed edge and outer chamber
Fig 2oh
Cut seal parallel to partially sealed edge and outer chamber
Fig 2oi
Cut seal perpendicular to partially sealed edge and outer chamber
Fig 2oj
Cut seal parallel to partially sealed edge and outer chamber
Fig 2ok
Cut seal perpendicular to partially sealed edge and outer chamber
Fig 2ol
Cut seal parallel to partially sealed edge and outer chamber
Fig 2om
Cut seal perpendicular to partially sealed edge and outer chamber
Fig 2on
Cut seal parallel to partially sealed edge and outer chamber
Fig 2oo
Cut seal perpendicular to partially sealed edge and outer chamber
Fig 2op
Cut seal parallel to partially sealed edge and outer chamber
Fig 2oq
Cut seal perpendicular to partially sealed edge and outer chamber
Fig 2or
Cut seal parallel to partially sealed edge and outer chamber
Fig 2os
Cut seal perpendicular to partially sealed edge and outer chamber
Fig 2ot
Cut seal parallel to partially sealed edge and outer chamber
Fig 2ou
Cut seal perpendicular to partially sealed edge and outer chamber
Fig 2ov
Cut seal parallel to partially sealed edge and outer chamber
Fig 2ow
Cut seal perpendicular to partially sealed edge and outer chamber
Fig 2ox
Cut seal parallel to partially sealed edge and outer chamber
Fig 2oy
Cut seal perpendicular to partially sealed edge and outer chamber
Fig 2oz
Cut seal parallel to partially sealed edge and outer chamber
Fig 2pa
Cut seal perpendicular to partially sealed edge and outer chamber
Fig 2pb
Cut seal parallel to partially sealed edge and outer chamber
Fig 2pc
Cut seal perpendicular to partially sealed edge and outer chamber
Fig 2pd
Cut seal parallel to partially sealed edge and outer chamber
Fig 2pe
Cut seal perpendicular to partially sealed edge and outer chamber
Fig 2pf
Cut seal parallel to partially sealed edge and outer chamber
Fig 2pg
Cut seal perpendicular to partially sealed edge and outer chamber
Fig 2ph
Cut seal parallel to partially sealed edge and outer chamber
Fig 2pi
Cut seal perpendicular to partially sealed edge and outer chamber
Fig 2pj
Cut seal parallel to partially sealed edge and outer chamber
Fig 2pk
Cut seal perpendicular to partially sealed edge and outer chamber
Fig 2pl
Cut seal parallel to partially sealed edge and outer chamber
Fig 2pm
Cut seal perpendicular to partially sealed edge and outer chamber
Fig 2pn
Cut seal parallel to partially sealed edge and outer chamber
Fig 2po
Cut seal perpendicular to partially sealed edge and outer chamber
Fig 2pp
Cut seal parallel to partially sealed edge and outer chamber
Fig 2pq
Cut seal perpendicular to partially sealed edge and outer chamber
Fig 2pr
Cut seal parallel to partially sealed edge and outer chamber
Fig 2ps
Cut seal perpendicular to partially sealed edge and outer chamber
Fig 2pt
Cut seal parallel to partially sealed edge and outer chamber
Fig 2pu
Cut seal perpendicular to partially sealed edge and outer chamber
Fig 2pv
Cut seal parallel to partially sealed edge and outer chamber
Fig 2pw
Cut seal perpendicular to partially sealed edge and outer chamber
Fig 2px
Cut seal parallel to partially sealed edge and outer chamber
Fig 2py
Cut seal perpendicular to partially sealed edge and outer chamber
Fig 2pz
Cut seal parallel to partially sealed edge and outer chamber
Fig 2qa
Cut seal perpendicular to partially sealed edge and outer chamber
Fig 2qb
Cut seal parallel to partially sealed edge and outer chamber
Fig 2qc
Cut seal perpendicular to partially sealed edge and outer chamber
Fig 2qd
Cut seal parallel to partially sealed edge and outer chamber
Fig 2qe
Cut seal perpendicular to partially sealed edge and outer chamber
Fig 2qf
Cut seal parallel to partially sealed edge and outer chamber
Fig 2qg
Cut seal perpendicular to partially sealed edge and outer chamber
Fig 2qh
Cut seal parallel to partially sealed edge and outer chamber
Fig 2qi
Cut seal perpendicular to partially sealed edge and outer chamber
Fig 2qj
Cut seal parallel to partially sealed edge and outer chamber
Fig 2qk
Cut seal perpendicular to partially sealed edge and outer chamber
Fig 2ql
Cut seal parallel to partially sealed edge and outer chamber
Fig 2qm
Cut seal perpendicular to partially sealed edge and outer chamber
Fig 2qn
Cut seal parallel to partially sealed edge and outer chamber
Fig 2qo
Cut seal perpendicular to partially sealed edge and outer chamber
Fig 2qp
Cut seal parallel to partially sealed edge and outer chamber
Fig 2qq
Cut seal perpendicular to partially sealed edge and outer chamber
Fig 2qr
Cut seal parallel to partially sealed edge and outer chamber
Fig 2qs
Cut seal perpendicular to partially sealed edge and outer chamber
Fig 2qt
Cut seal parallel to partially sealed edge and outer chamber
Fig 2qu
Cut seal perpendicular to partially sealed edge and outer chamber
Fig 2qv
Cut seal parallel to partially sealed edge and outer chamber
Fig 2qw
Cut seal perpendicular to partially sealed edge and outer chamber
Fig 2qx
Cut seal parallel to partially sealed edge and outer chamber
Fig 2qy
Cut seal perpendicular to partially sealed edge and outer chamber
Fig 2qz
Cut seal parallel to partially sealed edge and outer chamber
Fig 2ra
Cut seal perpendicular to partially sealed edge and outer chamber
Fig 2rb
Cut seal parallel to partially sealed edge and outer chamber
Fig 2rc
Cut seal perpendicular to partially sealed edge and outer chamber
Fig 2rd
Cut seal parallel to partially sealed edge and outer chamber
Fig 2re
Cut seal perpendicular to partially sealed edge and outer chamber
Fig 2rf
Cut seal parallel to partially sealed edge and outer chamber
Fig 2rg
Cut seal perpendicular to partially sealed edge and outer chamber
Fig 2rh
Cut seal parallel to partially sealed edge and outer chamber
Fig 2ri
Cut seal perpendicular to partially sealed edge and outer chamber
Fig 2rj
Cut seal parallel to partially sealed edge and outer chamber
Fig 2rk
Cut seal perpendicular to partially sealed edge and outer chamber
Fig 2rl
Cut seal parallel to partially sealed edge and outer chamber
Fig 2rm
Cut seal perpendicular to partially sealed edge and outer chamber
Fig 2rn
Cut seal parallel to partially sealed edge and outer chamber
Fig 2ro
Cut seal perpendicular to partially sealed edge and outer chamber
Fig 2rp
Cut seal parallel to partially sealed edge and outer chamber
Fig 2rq
Cut seal perpendicular to partially sealed edge and outer chamber
Fig 2rr
Cut seal parallel to partially sealed edge and outer chamber
Fig 2rs
Cut seal perpendicular to partially sealed edge and outer chamber
Fig 2rt
Cut seal parallel to partially sealed edge and outer chamber
Fig 2ru
Cut seal perpendicular to partially sealed edge and outer chamber
Fig 2rv
Cut seal parallel to partially sealed edge and outer chamber
Fig 2rw
Cut seal perpendicular to partially sealed edge and outer chamber
Fig 2rx
Cut seal parallel to partially sealed edge and outer chamber
Fig 2ry
Cut seal perpendicular to partially sealed edge and outer chamber
Fig 2rz
Cut seal parallel to partially sealed edge and outer chamber
Fig 2sa
Cut seal perpendicular to partially sealed edge and outer chamber
Fig 2sb
Cut seal parallel to partially sealed edge and outer chamber
Fig 2sc
Cut seal perpendicular to partially sealed edge and outer chamber
Fig 2sd
Cut seal parallel to partially sealed edge and outer chamber
Fig 2se
Cut seal perpendicular to partially

ADAPTIVE PACKAGING FOR FOOD PROCESSING SYSTEMS

PRIORITY

This application benefits from the priority of Provisional Patent Application No. 61/478,190, filed 22 Apr. 2011

| REFERENCES CITED | | |
|---|---|---|
| U.S. Patents | | |
| 4,206,299 | June 1980 | Yamazaki et al. |
| 4,476,263 | October 1984 | Owens |
| 7,008,501 | March 2006 | Lohwasser et al. |
| 7,178,555 | February 2007 | Engle et al. |
| 7,452,561 | November 2008 | Newman |
| 7,475,786 | January 2009 | McVay |
| Patent Application 12/005,596 | June 2009 | Hoffman |
| Patent Application 61/182,731 | May 2010 | Newman |
| Patent Application 61/488,220 | May 2011 | Newman |
| Foreign Patents | | |
| GB 2408440 | July 2002 | Newman |
| Other References | | |
| Principles of Aseptic Processing and Packaging, Nelson, P., Purdue University Press (3rd Ed.) 2010 | | |

FIELD OF INVENTION

The present invention relates to an apparatus and method for modifying and controlling a number of processing conditions, particularly pack pressure, gas volume and gas composition within a re-closable package which has one or more chambers which may be separate or continuous, one or more mechanisms, which may be active or passive, to allow controlled and selective movement of gas but not liquid and/or solids within the package and to its outside.

It further relates to the unique design and fabrication of a low-cost, flexible package, typically from a single piece of packaging material in a manner that allows it to contain and process one or more separate food components or mixtures which can be thermally processed, e.g. sterilized or pasteurized, simultaneously within a continuous or batch processing system and subsequently be stored, transported and handled without further modification while keeping the components essentially separate.

It also relates to the control and use of such adaptive packaging to significantly accelerate product cooking and cooling times while improving product quality and organoleptic properties.

BACKGROUND OF THE INVENTION

In-container sterilization has many benefits over other forms of food and drink processing. It is usually continuous compared with batch based retort systems, can process very large volumes of identical product, does not require the product package to be sterile before filling or processing unlike aseptic processing systems and can process solids, liquids and component mixtures with minimal change to processing conditions.

That being said, it does have a number of drawbacks. Because of the relatively long dwell times, it does tend to over-process many products. It cannot compensate its processing conditions quickly to accommodate changes in product properties such as variations in incoming temperature and/or fluctuations in composition. Neither can it easily process different product without a significant time and production delay as system process conditions are modified. (Although many of these issues have subsequently been successfully resolved using the inventions taught in U.S. Patent Application 61/488,220, Newman).

However, by far the greatest limitation is the constraint the system's extreme operating conditions place on the types of product packaging that can be accommodated. With operating temperatures often exceeding 120° C. and operating pressures in excess of 2 atmospheres, packaging materials are usually limited to those able to withstand such extremes of processing conditions such as sealed metal cans and, to a somewhat lesser degree, glass jars and bottles. Such processing conditions generating high temperatures and pressure within the product container, the container is often exposed to over-pressurization, i.e. pressure is applied to the external surfaces to counter-act the increased pressure within the container and the stresses to the container structure and integrity.

In addition, the liquid/gaseous nature of the sterilizing media prevents the use of many newer packaging materials, particularly those made from laminated card or paperboard. The prolonged immersion times in a liquid and/or high humidity atmosphere will cause such materials to become water sodden and lose their physical strength and integrity.

Similarly, many of today's alternative packaging materials are polymer-based. These will delaminate, soften or melt under such extreme processing conditions, while the often significant expansion of the package contents, particularly the gas/air in the package headspace will lead to seam rupture, wall weakening and/or package burst.

Finally, many laminate-based packaging will, when subjected to high temperatures and/or high moisture content environments, cause breakdown products, many often toxic such as terephthalates and bis-phenol-A, to be released into the food product within. The same also occurs with metal can coatings in contact with high acid foods at elevated temperatures.

There have been many attempts to overcome some of these issues. Such innovation teaches the use of pressure release valves within the packaging (Hoffman, U.S. patent application Ser. No. 12/005,596), the use of non-toxic coatings on the inner walls of cans (McVay, U.S. Pat. No. 7,475,786), alternative package liner materials that do not release toxic by-products (Owens, U.S. Pat. No. 4,476,263) and polymers which can withstand higher processing temperatures without failure (Yamazaki, U.S. Pat. No. 4,206,299, Lohwasser, U.S. Pat. No. 7,008,501). However, none of these alone or in combination will resolve many of the practical limitations associated with utilizing modem packaging materials within the continuous, in-container, thermal processing environment.

As well as the processing environment constraints, there are several other packaging-related issues that also need addressing.

Because of the physical extremes encountered with in-container sterilization, the container has traditionally been of robust construction, e.g. steel cans or thick-walled glass jars and bottles. While this allows product to be sterilized to required time-temperature and pressure conditions, it does so at a cost in fact several costs.

Firstly, the thickness of the container adds weight and cost through space (it is usually not collapsible and occupies its full volume even when empty), storage (same reason) and transport.

Secondly, the wall thickness requires additional energy to both heat up and cool down while negatively effecting the rate of heat transfer between the energy source (water or steam) and the product inside. This in turn affects the resultant product quality.

Many aseptic packages display enhanced graphics which makes them more attractive than a label from a sales and marketing perspective. However, these are costly to produce but they cannot withstand the rigors of the in-container sterilization. Alternative graphics printed on heat shrinkable film have been developed for adding to retort packages and could be added to in-container sterilized products but again at additional cost and more production time.

The final issue applies to all packages whether aseptic, retort or continuous—and that is their protective function. All packaging has to be suitable for purpose, i.e. it must retain and preserve the contents under the conditions of storage and display. Steel cans and glass jars and bottles, by their very nature, tend to be moisture impervious and oxygen impervious. The property of being light impervious is either inherent or generated by the addition of dyes into the glass or the use of further packaging such as cartons and boxes.

The same physical properties are generated within flexible cartons, pouches and packs through multi-lamination where each layer of the laminate generates a specific property. For example, an aluminum layer makes the package air and light controlled, an EvOH layer protects the aluminum layer for attack from high acid foods, a polypropylene layer allows the aluminum layer to be heat sealed, etc. There are also usually water proofing layers on inner and outer surfaces and a graphics protective layer. The result is a very efficient but expensive packaging system.

Finally there is the issue of packaging sterilization. All aseptic packages have to be separately chemically and/or physically sterilized as the package itself cannot be exposed to the same conditions as their contents. Many retort packages are processed at temperatures and pressures that only minimally pasteurize the container.

The embodiments and preferred embodiments of this invention address all of these issues by adapting the manner in which packaging materials are used to contain the foodstuff, optimize its processing, increase its flexibility and yet substantially reduce processing time and costs.

SUMMARY OF THE INVENTION

Definitions

In addition to specific definitions described elsewhere within this application, the following additional definitions are made 'Cooking' relates to the application of thermal energy to any food product or food product container so as to raise its temperature from any original starting temperature so as to change the status of the said food product, e.g. induce a state of stabilization, pasteurization or sterilization.

'Total Gas Volume' comprises and includes any gas present in the container prior to filling, any gas present in the foodstuff at the time of filling including dissolved gas and physically entrained gas, any gas subsequently added to the product container and/or the product prior to final sealing, any gas produced as a consequence of any chemical reaction occurring within the container or between the container and the foodstuffs or between the foodstuffs subsequent to the sealing of the container or any gas generated as a result of any change of state of any of the foodstuff constituents or the container itself subsequent to the sealing of the package and/or a consequence of any cooking or cooling step.

'Seal' relates to any method that can be applied to a food package so as to affect a physical separation between the internal contents of the package and the outside, irrespective of any action on the package or component within the package that may, deliberately or accidentally, subsequently result in a partial or complete destruction of the seal itself or the status of the package or the ability of any said seal to be reapplied.

'Approved for Food Use' relates to any component which, by regulation, legal approval, tacitly or by convention, can be used in any aspect of the manufacture, processing, storage, use containment and/or consumption of any foodstuff.

'Flowable' relates to gels, liquids and solids suspended, dissolved or floating in or on liquids, irrespective of viscosity, which under normal processing conditions are capable of movement in a continuous stream.

'Non-Flowable' relates to solids and liquids which have changed state as a result of physical or chemical reaction, such as freezing or precipitation or denaturation which are not capable of movement in a continuous stream.

It is an object of the present invention to provide an apparatus and method for reducing the time needed for an article, particularly a foodstuff, to be effectively sterilized, pasteurized or heat stabilized in a controlled and predictable manner within a fluid/gaseous processing environment using an adaptable, flexible packaging as a medium to constrain the foodstuff, control the food processing conditions and transport the foodstuff through the processing environment.

It is a further object to generate such reduced cooking and cooling times in any suitable cooking or cooling process but preferentially in a substantially continuous cooking or cooling process.

It is another object to provide an apparatus and method to improve or better maintain the organoleptic properties and overall quality of such processed foodstuff.

It is a further object of the invention to achieve the reduced processing times and enhanced product quality through the control of physical conditions within the package, in particular the gas pressure, gas volume and gas composition within the package.

In another object of the invention, processing times and enhanced product quality are further improved by optimizing the package structure and dimensions, in particular the surface area of the package relative to its content volume.

In a further object to the invention that the gas pressure, gas volume and gas composition within the package can be further modified as required, after the package has been charged with its food components.

It is yet another object to provide an apparatus and method to increase the capacity of the cooking or cooling process while reducing overall processing costs.

It is a further object of the present invention to provide an apparatus and method that will allow a wide variety of food and drinks products to be processed within the same system.

It is also an object of the invention to allow the adaptable packaging material to be used alone or as a component within the overall food packaging or container in a very wide variety of food and drink containers.

In another object of the invention, the physical dimensions of the adaptive packaging can be modified to optimize its physical properties and the processing of the product without affecting its capability to be used as a component of a food packaging container of fixed dimensions or fixed volume.

It is another aspect of the invention that any or all stated objects of the invention can occur while the package contents remain effectively sealed to the outside without the removal or transfer of the foodstuff from the food packaging at any point in the processing or any subsequent manufacturing, further processing and/or handling operation.

It is yet another object of the invention to allow both the foodstuff and its adaptive container to be effectively sterilized, pasteurized or heat stabilized in a single simultaneous processing operation and without requiring the container to be sterilized prior to it receiving the foodstuff.

It is a further object of the invention that the package be designed effectively from a single piece of packaging material with more than one chamber so that two or more foodstuffs, the same or different in composition, may be cooked simultaneously without mixing.

It is a final aspect of the invention that all of the above stated objects of the invention can be used individually or in any combination within any suitable continuous or batch cooking and/or cooling processing system.

BRIEF DESCRIPTION OF DRAWINGS a. FIG. 1 illustrates the basic design and function of the 2-chamber packaging container.

b. FIG. 2 illustrates the typical steps involved in the loading and sealing of the 2-chamber package with a single component foodstuff.

c. FIG. 3 illustrates the typical steps involved in the loading and sealing of the 2-chamber package with two different component foodstuffs.

DETAILED DESCRIPTION OF THE INVENTION AND PREFERRED EMBODIMENTS

We will now describe the preferred embodiments of the present invention in more detail with reference to the drawings. It will become obvious to anyone skilled in the art that the embodiments herein described can be utilized in many different formats, variants and configurations and therefore the described embodiments are merely used to illustrate the potential range and scope of the invention—not to restrict them.

First we will address the problems associated with reducing cooking and/or cooling time and our inventions to achieve these effects. It is obvious to anyone skilled in the art that, in a continuous cooking and cooling system, providing the product remains consistent, i.e. the composition and constituents do not vary beyond the allowable limits of an accepted standard for that product and the amount of available energy (for heat or cooling as needed) exceeds the total consumption required by the process for the product volume passing through the system, then providing there is no significant change in any other variable, the amount of cooking and/or cooling needed to ensure effective processing (e.g. sterilization) will be related to dwell time in a consistent manner.

We have surprisingly found (U.S. Patent Application 61/488,220, Newman) that by controlling any combination of speed and frequency and amplitude of agitation alone or in conjunction with optimizing product carrier design and product orientation, we can significantly improve the rate of energy transfer within the product with a concomitant improvement in both product quality and processing capacity and consistency in product organoleptic properties.

It is also known that the rate of energy transfer through a film of liquid foodstuff, e.g. fruit juice is considerably faster than through a similar thickness film of a foodstuff that contains particulates. The aseptic process method is based on passing energy (in the form of heating and/or cooling) rapidly through a thin film of foodstuff (Nelson, 2010). The dwell time of the foodstuff within the heating section of the process is adjusted so that the treated product receives sufficient energy to ensure it achieves the necessary level of pasteurization, (Nelson, 2010). However, this process becomes steadily less efficient as the ratio of solids to liquid increases and the greater the dimensions of the particulates, primarily due to the (generally) much slower transfer of energy through solids compared with liquids. As a consequence, and with an steady increase in the dwell times of the foodstuff in contact with the heated surfaces, there is an increasing tendency for one or more foodstuff components to become over processed and/or denatured.

In the retort process and the in-container process, the product is constrained within its container and the necessary energy is transferred from the system to the product but in different ways. In the retort system the product is essentially static and the processing environment changes around the product in stages. With the in-container system, the environment is static, i.e. each of the different chambers houses a different environment, e.g. hot water, steam, cool water, and the product is (essentially) passively transported through the different processing environments. A recent development, the continuous retort, is a compromise of the two systems.

As a consequence, and unlike the aseptic system, the retort and in-container systems are much less energy transfer efficient. A moving product is a more efficient energy transfer system than a static product. The product in the aseptic process has no container to interfere with energy transfer, neither does it have any supporting structures such as chains, drives or container holders to further reduce energy transfer efficiencies.

In general, the greater the extremes of temperature and pressure and the thicker the container, the lower the efficiency of energy transfer; the thinner the film the more effective the energy transfer. While U.S. Patent Application 61/488,220 (Newman) teaches apparatus and methodologies to improve energy transfer, particularly for 'in-container' processing, it does not provide any solution to the energy transfer inefficiencies due to the package, more particularly thick-walled and/or rigid containers, their shape, orientation and composition.

We have surprisingly found that through an apparatus and methodology which we describe as 'adaptive packaging', we can substantially improve energy usage and efficiency, product quality and capacity while significantly reducing total processing time, energy consumption and overall packaging costs.

For the purposes of this patent application, we define adaptive packaging as utilizing the physical characteristics and properties of the product packaging and its associated packaging system to potentially achieve all of the below-stated objects, but as a minimum to achieve at least objects of the invention 1 and 2 in addition to one or more of the objects/preferred embodiments a)-k)

1. The ability to modify the amount of headspace or the volume and/or pressure of any gases in the headspace of the packaging after the product has been loaded into the container and the container sealed.

2. The ability to modify the composition of headspace or the composition of any gases in the headspace of the packaging after the product has been loaded into the container and the container sealed.
   a) An acceleration of energy transfer between processing medium and product content
   b) Ability to withstand sterilization temperatures and pressure without the need for thick-walled and/or rigid construction.
   c) Ability to improve product mixing through inducing a change to the physical dimensions of the container by a passive or active mechanism.
   d) Ability to induce improved product mixing through controlled direct or indirect contact with the external surfaces of the container.
   e) Ability for the packaging to function as a product container in its own right without further modification.
   f) Ability for the packaging to function as a component of a finished product container without modification
   g) Form an easily opened and closable seal.
   h) Essentially comprised of recyclable or reusable materials.
   i) Enhance the organoleptic quality of the product within the packaging through one or more or any combination of these objects.
   j) Enhance the keeping quality and storage life of the product within the packaging through one or more or any combination of these objects.
   k) Protect the product contents by maximizing its puncture and burst resistance through packaging design and composition.

Before we detail the novelty and inventive step of each object, we will describe the basic package configuration that makes the 'adaptive steps' possible with reference to FIGS. 1 to 3.

Again, it will be obvious to those skilled in the art that there are many possible variations of this basic design. Therefore, the 'basic configuration' we describe is merely illustrative and is not meant to be confining or restrictive.

The Basic Package Design

In a preferred embodiment to the invention, the packaging consists of a flexible container with an inner chamber (10) and an outer chamber (20) connected by a capillary (55) formed by the selective seaming of the packaging as exemplified in FIG. 1. In a further preferred embodiment, the inner chamber (10) can be formed either as part of the one-piece which also forms the outside walls, floor and top of the overall package, or it can be a separate package heat welded to portions of the inside wall of the outer chamber (15). This essentially depends on the volume of product the container has to hold. It may be constructed of the same material as the outer chamber or different, depending on product and processing requirements.

The distal end of the inner chamber (10) is connected to the proximal end of the capillary (55) through a two-way gas and float valve (45). When the pressure of the inner chamber reaches a pre-determined level, the valve will open and the excess pressure will be released. When the excess pressure has been released, the valve will start to close but gas can still flow back into inner chamber until a pre-determined equilibration pressure is reached and the valve is shut.

This valve also functions as a float valve. This ensures that any solid and/or liquid contents of the inner chamber (10) do not escape into the capillary (55) and block the gas movement or pressure. When liquid tries to enter the air part of the valve, the floating seal is forced up to a flange and forms a liquid tight seal.

The distal end of the capillary (55) opens into the outer chamber (20) of the packaging which functions principally as an expansion chamber for the gaseous volume of the package contents. However, it also serves as a method of purging air and/or oxygen or any other unwanted gaseous component from the packaging. The distal end of the outer chamber connects with a simple one-way valve (50) which connects the outer chamber with the outside atmosphere. When gaseous pressure builds up inside the outer chamber and reaches a pre-determined value, the valve opens and the excess pressure is released.

In this way, as the product within the packaging expands with heating, excess pressure from the inner chamber is allowed to escape and equilibrate with the gas in the outer chamber. However should the pressure in the outer chamber exceed a pre-determined level, then this excess pressure can escape to the outside. This means that during the heating phase of any sterilization or pasteurization cycle, the outer chamber functions as an expansion chamber so the package is never subjected to extreme pressure. Equally as it cools, the internal pressure of the package never falls much below atmospheric, thus protecting the package from compression, collapse or implosion.

We have also found that, depending on product composition, package dimensions, product to package volume and inner chamber to outer chamber volume ratio, the inner valve is not required as the shape of the package neck (30) where it adjoins the proximal end of the capillary together with product viscosity will prevent expansion of the contents of the inner chamber into the outer chamber while allowing sufficient air/gas to be discharged to the outer chamber or the outside without package failure.

Acceleration of Energy Transfer Between Processing Medium & Product Content

The form and dimensions of a typical product container is determined, for the most part, by the functions it has to perform, with one notable addition, sales and marketing appeal. The less extreme the processing conditions, the wider the selection of materials that can be used to form the container.

With virtually all existing food and drink products and product containers, the effective rate of energy transfer is determined by the energy transfer capabilities of the product and the energy transfer properties of the product packaging together with the total energy availability and the temperature differential. Once the foodstuff is packed and the pack sealed, these parameters are fixed.

We have surprisingly found that we can significantly accelerate energy transfer by changing the dimensions of the product packaging. In a conventional package, can, jar, bottle, even a pouch, the dimensions are fixed once sealed. In a preferred embodiment, the adaptive package allows the product to spread into a larger volume for processing (FIG. 1). Faster processing will occur when the product volume assumes a greater surface area to volume ratio. With a consumer pack of typical dimensions of 15 cm×20 cm×2 cm, the pack has a capacity of 600 ml. If 300 ml of product are loaded into the pouch and sealed, then the product volume will fill the bottom half of the pouch and assume dimensions of 15 cm×10 cm×2 cm. This gives a volume of 300 ml and a surface area of 340 cm2, a ratio of 1.13. The remainder of the pouch will contribute little to energy transfer as it is devoid of product and acts minimally as a heat conductor or convector.

With the adaptive package and its structure, the outer chamber lining has preferred dimensions which are typically between 0.5 cm and 50 cm greater length and breadth compared with those of the inner chamber and between 0.1 cm and 10 cm greater depth.

More preferably, for consumer packs between 10 ml and 2000 ml, length and breadth dimensions are between 1.5 cm and 20 cm longer than those of the inner chamber and between 0.5 cm and 5 cm greater depth. If the limiting valve (45) is not present, the contents can fill both the inner and outer chambers and if the pack is orientated on its side, the product will spread and assume a dimension of 18 cm×13 cm×0.8 cm so a surface area of almost 500 cm2, a ratio of 1.6. A typical can of the same dimension has a ratio of 0.78 and a similar bottle of 0.83. Even if limiting valve (45) is present, the ratio will rise in excess of 1.5

The result, as shown in Table 1, is a very much faster rate of temperature rise or fall in comparison to a conventional rigid container or pack.

Withstanding Sterilization Temperatures and Pressure without the Need for Thick-walled and/or Rigid Construction.

Containers such as metal cans, glass bottles and jars will withstand the high temperatures and pressures of retorting and in-container sterilization but only because they are thick walled, relatively heavy, rigid and generally inflexible. As a consequence, and through necessity to maintain their function, their geometric shapes are relatively simple and limited, such as flat or tapered cylinders, and the rate of heat transfer is relatively slow and uneven due principally to a low surface area to volume ratio and minimal temperature differential.

During the heating phase, the contents will expand and the pressure will increase. (A liquid product filled into a can at 20° C. and processed to sterilization temperatures, will expand its liquid volume by about 5% and its gas volume by almost 40%). However, a conventional package cannot compensate and therefore needs to withstand the increase in both temperature and pressure. Many plastic based materials will soften at pasteurization temperatures but remain intact. Few will withstand sterilization temperatures without rupture.

We have found in a conventional non-rigid product container, if the package pressure can be reduced, the container will remain intact and the package only needs to withstand the temperature change. However, during the cooling phase, the internal pressure will now decrease and become lower than the external pressure causing the container to compress and eventually fracture.

In conventional retort or in-container processing, the atmosphere external to the container but internal within the processing system, is pressurized as the temperature increases so that the equilization of the two pressures prevents container rupture. It is released as the temperature falls.

In a preferred embodiment, we have found that by minimizing the gas volume within the package significantly reduces internal pressure increase at sterilizing temperatures. Designing the package so that the contents can expand sufficiently either within the primary inner chamber (10) or if necessary into the additional space of the outer chamber (20) via the neck (30) and adjoining capillary (55) of the inner pack while limiting gas expansion exerts minimal pressure on the package through valve assembly (50). While such a package can be made from any suitable material, because of their structural characteristics, many polymer-based materials can additionally stretch in one or more dimensions without rupture, providing a further means of counteracting pressure changes and they are the preferred material for the entire chamber construction or, at least, the construction of the inner chamber.

Improving Product Mixing Through Inducing a Change to the Physical Dimensions of the Container by a Passive or Active Mechanism.

We have shown that providing the contained product with additional space to expand into will significantly accelerate processing times. In a preferred embodiment, we have also been able to demonstrate that the provision of additional space within the container also improves product mixing.

As the product moves through the processing system, because of the greatly increased area to volume ratio, it can move greater distances and at greater velocities than similar volumes of product in a conventional can, bottle or pouch.

In a preferred embodiment, combining the design of the additional space within the adaptive package with the enhanced agitation methods described in U.S. Patent Application 61/488,220, herein incorporated by reference, further enhances the mixing of the product components and enhances the rate of energy transfer.

Inducing Improved Product Mixing Through Controlled Direct or Indirect Contact with the External Surfaces of the 'Adaptive Packaging' Container.

Where containers are rigid and/or inflexible, the only practical method of improved product mixing and thus enhanced energy transfer is container agitation. When containers are more flexible and the immediate external wall surfaces of the container more malleable, additional mixing of the product can be generated by physically contacting the external surfaces of the container and inducing movement of the internal contents.

While there are many different ways this can be induced, in a linear processing system such as ICS, in a preferred embodiment, this is best achieved through a wave or roller motion. In a conventional ICS system where product is held and/or stacked within product carriers and passively progresses through the processing system, this can best be achieved prior to loading and after unloading the product by passing the package through a simple counter acting roller assembly which compresses the container along its length, forcing the product contents toward one end of the container and then a reverse system will force it backward.

In systems where the product package can be actively transported through the processing system singularly or in multiples, with or without the use of product carriers, a different approach can be used.

In a further embodiment, we have surprisingly found that we can induce very efficient agitation and mixing to the package contents if the package can be transported through the system using a converging conveyor system where the conveyor beds of two adjacent vertical conveyors move in parallel directions, trapping the package between the nip of the belting of the two conveyors and propelling it forward. The act of trapping the package will cause the contents of the packaging to be moved forward or backward within the packaging, depending on the direction of motion of the conveyors receiving the package. This mixing motion can be repeated many times as the packaging moves through the system.

Modifying the Amount of Headspace or the Volume and/or Pressure of any Gases in the Headspace of the Packaging after the Product has been Loaded into the Container and the Container Sealed.

With few exceptions, the headspace volume and thus the gas content of any food or drink product is fixed once the container is filled and the cap or lid applied. In addition to ensuring the cap or lid is applied to a dry surface and limiting the chances of forming a vacuum, the headspace is required to allow the contents to be mixed either passively through convection and conduction or actively, and more effectively, through agitation while the cap/lid remains in place. However, this creates a number of issues.

Firstly, it results in variable heating and cooling as the passage of energy through air/gas is much slower than through liquids or solids. This in turn causes cold spots formation within the container. The headspace is also necessary to allow the contents of the package to expand as it heats. However the residual air/gas in the headspace also expands and this causes the increase in pressure within the container and thus the need for the container strength requirement.

We have found that we can both modify the headspace volume and create a differential pressure within the container by the introduction of two valves in the package. One, the outer chamber valve (50) is a one-way pressure valve, the other (45), is a two-way valve. In preferred embodiments to this invention, one valve (45) is located between the inner chamber of the package and the duct/capillary connecting the inner chamber to the outer chamber; the second valve (50) is located in the vertical surface of the outer chamber of the package, in any of the wall surfaces. It is a further preferred embodiment that the location of this second valve is positioned so as not to hinder the subsequent location and formation of an easy-open seal, a further embodiment described later.

While the use of seals to alleviate pressure build-up is well known (U.S. Pat. No. 7,178,555, Engel), the purpose of adding valves to this package is to enable the manufacturer to modify the volume of the head space to best suit both the product and the packaging application. We have surprisingly found that the need for one, both or neither of the valves is very dependent upon both these requirements.

For example, if the product is a liquid with no or minimal solids and the requirement for headspace is minimal, then the inner valve (45) is not required and the headspace volume can be manufacturer controlled using the outer valve (50) alone. However, if the product contains particulates then it is essential that the inner valve does not get blocked. In a further preferred embodiment, the inner valve is designed so that air/gas can continue to pass through the valve unhindered as the product expands. If liquid enters the valve, the floating valve seating rises and seals the valve. As the pressure falls and the liquid or liquid/particulate volume shrinks, the valve reopens to air/gas movement and equilibration of the inner package chamber can occur. A more detailed explanation is given with Example 1.

In a further embodiment, either or both valves can be treated with suitable chemical or physical indicators (approved by regulatory bodies for food use) that visibly indicate whether the package has leaked such as water penetrating into the package or product contents have escaped from the package and/or air has leaked into the package. Examples of this are well-known; (for water/liquid) a suitable pH indicator embedded in a food allowable gel such as alginate or carraghenan and (for oxygen/air) methylene blue/ferrous/magnesium salt mixtures.

a. Modifying the Composition of Headspace or the Composition of any Gases in the Headspace of the Packaging after the Product has been Loaded into the Container and the Container Sealed.

In a previous object to the invention, the use of valves has been designed to modify the headspace volume and pressure in both the inner and outer chambers of the packaging and for preventing liquids and solids escaping from the inner chamber to the outer. However, we have surprisingly found that we can also control the organoleptic and keeping qualities of the product within the package by controlling not only the volume and pressure of the headspace but also its composition.

It is know to those skilled in the art of food science and technology that the presence of air or oxygen can contribute significantly to the deterioration of the organoleptic and/or keeping qualities of the product (GB 2408440, Newman; U.S. Pat. No. 7,452,561, Newman). Oxidation reactions can occur and/or be catalyzed in many ways including but not limited to the presence light, temperature, enzymic reaction, microbial growth and/or the process of auto-oxidation, especially prevalent in proteins where the reaction is a chain reaction that is self-perpetuating and continues until all the available oxygen has been exhausted.

There are three principle procedures adopted by food and drink product manufacturers to eliminate or minimize these occurrences, namely vacuum packaging, a process where the air is removed by suction and the package sealed; modified atmosphere packaging where the air containing atmosphere is removed from the package and/or replaced by the addition of another gas mixture or through the use of oxygen scavengers and/or anti-oxidants, where residual oxygen is physically or chemically bound in an inactive form.

While it is relatively easy to incorporate one or more of these processes into the preservation of raw and chilled foods, it is much more difficult to do so with pasteurized and sterilized foods, primarily because of the inability to change the atmosphere composition either while the product is being loaded into the package or once the product has been sealed within its container.

With the rate of reaction doubling for each 10° C. increase in temperature, the extreme elevations of temperature encountered with pasteurization and more particularly sterilization, will rapidly result in excessive product oxidation and denaturation, the main causes of loss of organoleptic quality in sterilized foodstuffs.

We have surprisingly found that we can significantly reduce or virtually eliminate such oxidative activity in the product through purging oxygen from the headspace after the product package has been filled and sealed using a low cost approach.

While there are many different technologies to achieve this, they are costly and unacceptably slow for a high throughput manufacturing operations. In a preferred embodiment, a small pellet of carbon dioxide is added to the contents of the inner package chamber via the neck (30). If the product is liquid or predominantly a liquid with particulates, the CO2 pellet is added after the product has been filled into its packaging and immediately prior to sealing. If the product is predominantly solid, we have found that adding the CO2 pellet before the container contents, results in a more efficient purge of air from the package.

The carbon dioxide pellet changes state from solid to gas and the now sublimated gas permeates from the inner package chamber through the inner two-way valve (45—if present) along the capillary chamber (55) into the outer package chamber. If the pressure exceeds that required for the package, the excess pressure is relieved through the opening of the outer valve (50).

As carbon dioxide is considerably denser than air or oxygen, it preferentially pushes air/oxygen from the package (Table 2). We have also found in many foods that the carbon dioxide has a much higher solubility than oxygen and further displaces more oxygen from the product mixture. The amount of CO2 needed to displace the air/oxygen within the pack will obviously be related to both product volume to package volume ratio and any dissolved oxygen. However, we have found for most applications, a pellet of 0.25 to 0.50 cc is adequate.

We have further found that the rising temperature that occurs during pasteurization and, more preferably, during sterilization also causes oxygen and/or air to be driven from the product. It is also known that oxygen can become trapped between the layers of multi-laminate films. The carbon dioxide atmosphere surrounding the product forces this air away from the product and further reduces the potential for product oxidation.

In a further embodiment, once all/most of the carbon dioxide has been released, and if needed, the outer package can be additionally sealed at any suitable point below the location of the outer valve (50), see FIG. 2*d*, at B-B$^1$. This will further ensure that the package contents remain sterile during and after processing. In a preferred embodiment, the additional sealing occurs after the package has been subjected to a gentle compression of its outer walls by any suitable mechanism, more preferentially a roller to create a small negative gas pressure within the package. This not only ensures that virtually all the air is expelled from the package, it also significantly reduces the maximum pressure exerted during processing as the total package residual gas volume is extremely small, preferentially 20 cm2 or less, more preferentially, 5 cm2 to 10 cm2, even more preferentially, 2 cm2 to 5 cm2 per 400 ml of product.

We have further found that, for many applications, outer valve (50) can be replaced with a simple exit hole to the outside. For optimum flexibility, this will be located as far away from the distal end of the capillary (55) as is practical for the product/container combination.

It is obvious to anyone skilled in the art that for a fixed volume, a product free from particulates will expand more than one with particulates when heated. Providing the product composition is known, the amount of this expansion is calculable. However what is not as calculable is the total gas volume, including any dissolved or physical entrained gases, that will be released on heating. This makes the headspace volume much more difficult to calculate and, as gases expand far greater than liquids or solids, the resultant pressure in the sealed package.

We have found that adding the package compression step, with or without the addition of carbon dioxide, will further significantly reduce both the headspace volume and the internal package pressure during processing.

We have also surprisingly found that using these methods in combination with the novel package design, the package is less likely to collapse when the product is cooled as the change in internal pressure is considerably less than with conventional packaging and remains close to atmospheric.

Protect the Product Contents by Minimizing Package Failure and Maximizing Puncture-resistance.

It is obvious to those skilled in the art that there are many different ways to minimize package failure including but not limited to using thicker films, using multi-laminate films, using puncture-resistant films, using metallized films, double seaming, etc.

In the raw food industry, particularly the raw meat, poultry and fish industry, the concept of the 'pillow pack' is also well-known: (this is where the addition of a modified or controlled atmosphere through gas flushing adds a layer of air/gas between the product and the packaging walls). The main reason for this is to add an excess of gas to slow down the rate of any product deterioration due to the oxygen transmissibility of the packaging film. However as this increases the pressure within the pack there is a greater chance of puncture or seam failure.

What we have surprisingly found is the dual chamber design of the pack together with the carbon dioxide atmosphere provides a protective buffer between the product contents in the inner chamber and the outer package chamber without the need for excessive gas pressure. It also allows thinner films to be used without increasing the risk for pack failure, thus reducing packaging costs.

While the films selected will be optimal for the product being packaged. However, we have been able to demonstrate the protective function of the package design for a wide range of packaging materials.

Designing the Packaging to Function as a Product Container in its Own Right without Further Modification.

The use of single films such as Nylon or single films of multi-laminate construction such as DuraShield™ as the casing for a food product are well known; examples include milk, fruit juices and edible oils. However, for protection during transportation and storage, such product casings are usually covered by a further protective layer in the form of a carton, box or tube. While this makes the materials costs substantially less than a similar bespoke multi-laminate container such a TetraPak™ or CombiBloc™ carton, it still generates additional cost because of the need for protection.

Also, it should be mentioned that all of the product packaging of these types are designed for hot fill or aseptic pasteurization temperatures. They are not designed for either sterilization nor in-container sterilization nor retort sterilization nor for products with large particulates nor those that are essentially solids.

We have found that our unique design of the product container allows us to produce a strong oxygen, moisture and light impervious container from just two or three materials. Where the product container does not require the inclusion of the inner valve (45), the two materials can be created as a heat formed laminate. In a preferred embodiment, the inner layer is composed of a suitable high temperature polymer approved for food use such A-PET, C-PET or PEN, especially resilient to high acid foods. This is laminated to an outer layer of Aluminum foil which may or may not be additionally treated to prevent high acid foods from reacting with the Aluminum, while the necessary structural shape of the bag and the seals are easily created by heat sealing and/or seaming. An alternative to the Aluminum layer is treated reinforced regenerated cellulose (as detailed in U.S. Patent Application 61/182,731 to Newman, hereinafter incorporated by reference). As detailed in that application, the cellulose can be treated both during manufacture and afterward to modify its moisture, gas and light permeability to optimally suit the product requirements. Regenerated reinforced cellulose is considerably cheaper than Aluminum to manufacture and totally biodegradable. It also has lower costs to produce any required package artwork.

Where the inner valve is required, we have found that two configurations perform particularly well. In one preferred embodiment, the inner chamber is comprised of a separate suitable high temperature polymer approved for food use with the valve embedded at a suitable location which will vary according to product volume and product composition, particularly liquid to solid ratio but its general location is in agreement with that shown in FIG. 1. The inner chamber is secured to the outer chamber by means of heat seals around its perimeter which also create the capillary to connect to the outer chamber. This arrangement works well for retail size packages, typically from 25 ml to 2.51.

In a further embodiment, in particular for larger volume packages for food service and wholesale, typically holding a product volume of 31 and upward, the same configuration and construction methods are used, except that the inner chamber is only sealed to the outer chamber to a point (22) which is approx 5 cm beyond the interface of the bottom wall of the inner chamber and its right hand side wall (20). This is primarily because there is usually a larger headspace volume that needs initially to be displaced and the more limited fixture of the inner chamber to the outer chamber provides more room in the outer chamber for the larger volume of carbon dioxide to expand into and expel the residual air/oxygen.

Forming an Easily Opened Seal in One or More Walls of the Packaging.

There are many forms of easy-open seals for food packages known to those skilled in the art.

In a preferred embodiment, the placement of heat seals along A-A' and B-B', with A' and B' intersecting forms a slightly weakened line in the package. Placing a small notch at the intersection of A' and B' allows the package to tear easily along B-B'.

In a further embodiment and as a preferred alternative, embedding a resealable seal, such as found in Ziploc™ or similar bags, so that the resealable seal is positioned below heat seal A-A' and spanning at least the neck of the inner chamber (30) and affixed into the walls of the outer chamber (20), allows the bag to be cut above C-C' but below A-A', exposing the contents of the inner chamber (10) for emptying through the original neck (30) but allowing the bag to be resealed along C-C' if residual contents remain.

Maintaining the original loading 'neck' of the package allows the package to have both a usable opening for unloading the contents of the package as well as preserving any residual content without the need for inserting a separate neck, spout, tap or filler cap to the package—a major cost and high-speed construction and production constraint for previous similar packaging products.

Constructing the Package of Essentially Biodegradable, Recyclable or Reusable Materials.

All of the preferred materials, irrespective of whether the package is comprised of one or two separate containers, whether the metalized component is surface treated and/or laminated, and/or whether the non-metalized components are polyethylene or polypropylene based materials in laminated or non-laminated format, are all fully recyclable and/or reusable. If regenerated cellulose is used, such material is totally biodegradable.

Enhancing the Organoleptic Quality of the Product within the Packaging Through One or More or any Combination of these Objects.

Taste panel results (Table 3) indicate that when identical product, processed in either conventional ICS packaging, or conventional retort packaging or the novel 'adaptive' packaging described in this patent application, are compared, the organo-leptic quality of product processed in the adaptive packaging has significantly higher approval ratings compared with conventional processing packaging.

Enhancing the Keeping Quality and Storage Life of the Product within the Packaging Through One or More or any Combination of these Objects.

Taste panel results (Table 3) indicate that when identical product is processed in either conventional ICS packaging, or conventional retort packaging or the novel 'adaptive' packaging described in this patent application and the processed product held under identical storage conditions (e.g. non-refrigerated warehouse at 10° C.-15° C.), are compared, the organoleptic quality of product processed and stored in the adaptive packaging has significantly higher approval ratings compared with conventional processing packaging. Instrumental measurements of indicator oxidation products (Table 4) are in agreement with Taste Panel results.

Designing the Package to Contain More than One Component and Prevent or Control their Mixing.

We have surprisingly found that with a very small modification to the 'adaptive packaging' as described herein, we can process two products in the same package, because of the considerably accelerated processing times and conditions.

The products can be the same, e.g. 2 separate portions of sauce or juice, or they can be different, e.g. meal components such as pasta and sauce or vegetables and a gravy.

In a preferred embodiment, the dimensions of the adaptive package are modified so that those of outer chamber are increased to ensure that the package can accommodate the required portion size of the second food component. This is achieved by extending the outer vertical wall (15A, FIG. 3) closest to the outer valve (50) sufficient for purpose. This also forms a suitable filling neck for the outer chamber. This will be sealed when the package is sealed with the heat seam at B-B'.

At the same time, the angle of vertical seam of the inner wall (15B) closest to the outer valve (50) is changed from vertical (with reference to the bottom wall of the package) to an acute angle, preferably 45° to 89° with reference to the bottom wall of the package.

This serves two major purposes, to minimize the necessary increase in overall bag size and minimize the amount of materials used. More importantly, the distal end of the capillary within the outer chamber (58) is shortened to accommodate the increased volume. It is essential that the capillary outlet is not blocked or the escape of pressurized gas/air/CO2 hindered. Controlling the obtuse angle formed ensures that no product can cover the distal end of the now shortened capillary. It is obvious to those skilled in the art that the particle size of suitable food components for this dual fill can vary enormously. Therefore, the acute angle needed to best suit purpose will similarly vary, as will package dimensions.

We will now describe a typical use of the package. However, as described within this application, it will be obvious to those skilled in the art that there are many possible variants and configurations both to the package and the methodology of utilizing the package. Accordingly, the following examples are meant only to be illustrative of the major claims of the invention and, in no way, limiting to it.

EXAMPLE 1

Use of the Adaptive Package with a Single Component Foodstuff

A volume (500 ml) of chicken noodle soup with vegetables (at 60° C.) is charged into the inner chamber (10) of the package through the open neck of the package (30). After the completion of the fill, a small pellet (88) of solid Carbon Dioxide (0.25-0.50 g) is added to the package. This rapidly sublimes into gaseous CO2.

The package is then heat sealed at the lower part of the neck (30) along the plane A-A'. This seals the package contents from the immediate outside. The sublimed CO2 causes the inner chamber to inflate. Once the inner chamber reaches a pre-determined level, typically between 20-30 psi, the inner valve (45) opens and the excess gas pressure is vented along the capillary (55) into the outer chamber (20) which also inflates.

If the pressure in the outer chamber (20) reaches between 20-30 psi (typically), the outer valve (50) opens and the excess pressure is vented to the atmosphere. After sealing, the contents are agitated within the package by any suitable means, typically, a pair of rollers make contact with the outer walls (15) of the package at a suitable location. This location varies with package size, product volume and composition but is usually sufficiently below the top level of the product so that when the roller pressure is applied, a small amount of liquid is trapped above the rollers. Typically, the package is now gently rolled in a vertical motion to a point close to the left edge of the seam (A).

This rolling motion has two effects. It ensures that the internal pressure within the inner chamber is close to atmospheric. It also ensures that any residual air/oxygen or other unwanted gaseous components are pushed out of the inner chamber through valve (45) and capillary (55) into outer chamber (20).

After completion of the second heat seam is applied horizontally across the whole of the package width along the plane B-B', immediately below the lower edge of the outer valve (50). This second seam intersects with the seam A-A' at A'. The package is now fully sealed from the outside atmosphere and processing environment. However, the sealed product package now has a controlled atmosphere effectively depleted of oxygen/air and a controlled gaseous volume so that during processing it will not be subjected to physical conditions that will cause puncture, burst or failure.

EXAMPLE 2

Use of the Adaptive Package with Dual Component Foodstuffs

A volume (200 ml) of cheese sauce (at 50° C.) is charged into the inner chamber (10) of the package through the open neck to the inner chamber of the package (30). A volume (300 g) of gnocchi (at 50° C.) is charged into the outer chamber (20) of the package through the open neck of the outer chamber of the package (35).

After the completion of the fill, a small pellet (88) of solid Carbon Dioxide (0.25 g-0.50 g) is added to the inner chamber of the package. This rapidly sublimes into gaseous CO2.

The package is then heat sealed at the lower part of the inner chamber neck (30) and the outer chamber neck (35) along the plane A-A'. This seals the inner chamber contents from the immediate outside. The subliming CO2 causes the inner chamber to slowly inflate.

Once the inner chamber reaches a pre-determined level, typically between 20-30 psi, the inner valve (45) opens and the excess gas pressure is vented along the capillary (55) into the outer chamber (20) which also inflates.

If the pressure reaches between 20-30 psi (typically), the outer valve (50) opens and the excess pressure is vented to the atmosphere. The package is then agitated by any suitable means. Typically, a pair of rollers now make contact with the outer walls (15) of the package at a suitable location. This location varies with package size, product volume and composition but is usually sufficiently below the top level of the product so that when the roller pressure is applied, a small amount of liquid is above the rollers. The package is now gently rolled in an upward and vertical motion to a point close to the left edge of the seam (A). If the product in the outer chamber is a solid or a particulate that would be organoleptically damaged by the application of pressure rollers, then the rollers only make contact with the liquid contents in the inner chamber.

This rolling motion has two effects. It ensures that the internal pressure within the inner chamber is reduced closer to atmospheric. It also ensures that any residual air/oxygen or other unwanted gaseous component is pushed out of the inner chamber through valve (45) and capillary (55) into outer chamber (20).

A second heat seam is applied horizontally across the whole of the package width along the plane B-B', immediately below the lower edge of the outer valve (50). This second seam intersects with the seam A-A' at A'. The package is now fully sealed from the outside atmosphere and processing environment. However, the sealed product package now has a controlled atmosphere effectively depleted of oxygen/air and a controlled gaseous volume so that during processing it will not be subjected to physical conditions that will cause puncture, burst or failure.

It should also be noted that where certain properties of foodstuffs such the water activity or the moisture content remain low or viscosity remains high, it is unlikely that there will be any physical mixing of components: in such instances, the inner valve (45) can be omitted from the pack configuration. If there is a substantial difference in water activity or water content of a component then the inner valve (45) acts as a suitable barrier between the two.

It should be further noted that where there is a substantial difference in water activity and/or water content of foodstuff components then the highest water content/water activity product is always filled into the inner chamber. The CO2 will react with the free moisture either in the headspace and/or at the headspace/foodstuff interface and form Carbonic acid.

This has the additional effect of lowering the free moisture content in the headspace, reducing water activity and enhancing keeping quality and shelf-life.

Finally, it should also be noted that if the water content/water activity of the outer chamber foodstuff is also suitably low then there is no need for the outer valve (50) and the outer chamber (20) can be vented to outside by means of a simple aperture or opening, usually at the furthest distance from the distal end of the capillary (55). However, maintaining at least a small positive pressure differential between the outer chamber and the outside atmosphere appears to always enhance the organoleptic and keeping qualities of the foodstuff as well as the puncture resistance of the adaptive package.

EXAMPLE 3

Comparison of Thermal Conductivity Performance Conventionally and Adaptive Packaged Foodstuffs

TABLE 1

Rate of Temperature rise in adaptive package and conventional can.
(Product - 400 ml of Chicken Noodle Soup in 485 g Can & 498 ml capacity Adaptive Pack)
Water Temperature - 95° C.
Product Temperature (Liquid Component) (° C. measured at centre of package)

| | 0 min | 0.5 min | 1 min | 1.5 min | 2 min | 2.5 min | 3 min | 4 min | 5 min | 6 min | 7 min |
|---|---|---|---|---|---|---|---|---|---|---|---|
| Can | 28 | | 40 | | 51 | | 64 | 75 | 79 | 83 | |
| Adaptive Package | 27 | 48 | 59 | 68 | 77 | 84 | | | | | |

TABLE 2

Gas composition and volume in the package before and after adaptation compared with a conventional sterilizable package.
(Product - 400 ml of Chicken Noodle Soup in 485 g Can & 498 ml capacity Adaptive Pack)
Air Temperature - 15° C. Water Temperature - 95° C.

| | Before Sealing | | | After Agitation/Sealing | | | After Heating | | |
|---|---|---|---|---|---|---|---|---|---|
| | % O2 | % CO2 | Total Volume | % O2 | % CO2 | Total Volume | % O2 | % CO2 | Total Volume |
| Can | 20 | 0 | | 20 | 0 | | 14 | 0 | |
| Adaptive Package | 9 | 74 | | 1> | <99 | | 1> | <99 | |

TABLE 3

Comparative taste panel organoleptic data for a foodstuff in conventional and adaptive packaging immediately after processing and 6 weeks storage at 10° C.
Product - 400 ml of Chili (35% fat) in sauce
(485 g Can & 498 ml capacity Adaptive Pack)
Rating: 1 = Poor to 7 = Excellent

| | | Color | Taste | Texture |
|---|---|---|---|---|
| Can | 0 wk | 4.1 | 3.2 | 3.0 |
| | 6 wk | 2.9 | 2.6 | 2.1 |
| Adaptive | 0 wk | 6.4 | 6.7 | 6.2 |
| | 6 wk | 5.9 | 6.2 | 5.7 |

TABLE 4

Comparative instrumental data for a foodstuff in conventional and adaptive packaging immediately after processing and 6 weeks storage at 10° C.
Product - 400 ml of Chili (35% fat) in sauce
(In 485 g Can & 498 ml capacity Adaptive Pack)
Rating: 1 = Poor to 7 = Excellent

| | | Color (Colorimetric) (expressed as L, a, b) | Taste (TBARS) (umol/kg) | Texture (Viscometry) (dyn cm-2 @ 35° C.) |
|---|---|---|---|---|
| Can | 0 wk | 38, 18, 14 | 17 | 196 |
| | 6 wk | 28, 11, 7 | 31 | 119 |
| Adaptive | 0 wk | 46, 28, 22 | 8 | 389 |
| | 6 wk | 42, 23, 19 | 11 | 337 |

The invention claimed is:

1. A flexible packaging assembly for receiving both flowable and non-flowable foodstuffs and then storing the flowable and non-flowable foodstuffs during and after thermal processing, the packaging assembly capable of withstanding thermal processing, including sterilization temperatures and pressures, comprising:

(a) at least two layers of flexible materials:

(i) forming a first internal chamber of the packaging having a perimeter extending along the margins of the first internal chamber and forming a filler opening in communication with the first internal chamber, the first internal chamber defining a first volume section for receiving foodstuff through the filler opening and a first headspace volume section such that, when the first volume section receives the foodstuffs, the headspace volume section is located above the surface of the foodstuffs and below the filler opening, the first internal chamber having a length spanning first and second ends of the first internal chamber, (ii) forming a second internal chamber of the packaging assembly defining a second foodstuff receiving volume section and an expansion headspace volume section open to the second foodstuff receiving volume section such that, when the second foodstuff receiving volume section receives the foodstuffs, the expansion headspace volume section is located above the surface of the foodstuffs, the second internal chamber having a length spanning first and second ends of the second internal chamber, and (iii) forming an internal capillary leading from the first headspace volume section of the first internal chamber to the expansion headspace volume section of the second internal chamber at a location between the first and second ends of the second internal chamber, said capillary formed between the two layers of flexible material to connect the first headspace volume section of the first internal chamber with the expansion headspace volume section of the second internal chamber;

(b) the filler opening configured to be sealable after receiving the foodstuff into the first internal chamber;

(c) a first control mechanism operable to permit and control, during thermal processioning of the foodstuffs as well as during and after the sealing of the first internal chamber, the flow of gases between the internal capillary and the first internal chamber but not permitting the flow of liquids and solids from the first internal chamber to the internal capillary; and (d) a second control mechanism for permitting and controlling the movement of gases from the expansion headspace section of the second internal chamber to the outside atmosphere during thermal processing.

2. A flexible packaging assembly according to claim 1, wherein the first internal chamber and the second internal chamber have common wall surfaces.

3. A flexible packaging assembly according to claim 1, wherein the first control mechanism for controlling the movement of solids, liquids, and gas is active or passive.

4. A flexible packaging assembly according to claim 1, wherein the packaging assembly is also able to withstand product processing conditions comprising product stabilization and product pasteurization temperatures and pressures.

5. A flexible packaging assembly according to claim 1, wherein control of the composition of gas of the packaging assembly reduces or eliminates product oxidation conditions during processing and subsequent storage.

6. A flexible packaging assembly according to claim 1, wherein control of gas pressure and volume within the packaging assembly increases the total surface area to volume ratio of the packaging assembly in contact with thermal processing media, which improves product organoleptic qualities by accelerating processing time.

7. A flexible packaging assembly according to claim 1, wherein at least one of the first and second control mechanisms displays a physical indication of any liquid or solid flow between the first internal chamber or the second internal chamber and the internal capillary or to the outside atmosphere.

8. A flexible packaging assembly according to claim 1, wherein at least one of the first and second control mechanisms displays a physical indication of residual oxygen or air in the first internal chamber or the second internal chamber or the internal capillary.

9. A flexible packaging assembly according to claim 8, wherein the physical indications of the at least one of the first and second control mechanisms are used to improve processing conditions and ensure safe product processing.

10. A flexible packaging assembly according to claim 1, wherein the first internal chamber, the internal capillary, and the second internal chamber are formed substantially from a single piece of packaging material.

11. A flexible packaging assembly according to claim 10, wherein the first internal chamber and the second internal chamber with the internal capillary are initially separately formed and then adjoined to any other layer which the packaging assembly may comprise.

12. A flexible packaging assembly according to claim 1, wherein after opening, one or more of the first internal chamber and the second internal chamber are independently resealable.

13. A flexible packaging assembly according to claim 1, wherein the internal capillary is formed by selective seaming of the two layers of flexible material forming the enclosure.

14. A flexible packaging assembly according to claim 1, wherein the at least one of the first and second control mechanisms comprises a flow valve operable based on a pressure differential across the flow valve.

15. A flexible packaging assembly according to claim 14, wherein the flow valve is selected from the group consisting of a one-way valve and a two-way valve.

16. A flexible packaging assembly according to claim 1, wherein the second control mechanism is located relative to the second internal chamber at a position distal to the internal capillary.

17. A flexible packaging assembly according to claim 1, wherein the second control mechanism comprises a one-way valve.

18. A flexible packaging assembly according to claim 1, wherein the first control mechanism comprises a two-way valve.

19. A flexible packaging assembly for receiving both flowable and non-flowable foodstuffs and then storing the flowable and non-flowable foodstuffs during and after thermal processing, the packaging assembly capable of withstanding sterilization temperatures and pressures, comprising:

(a) at least two layers of flexible materials forming:

a first internal chamber of the packaging assembly, a filler opening in communication with the first internal chamber, the first internal chamber defining a volume for receiving foodstuff through the filler opening and a headspace volume such that, when the volume for receiving foodstuffs is filled with the foodstuffs, the headspace volume is located above the surface of the foodstuffs and below the filler opening, the first internal chamber having a length spanning first and second ends of the first internal chamber, a second internal chamber of the packaging assembly defining an expansion headspace section such that, when the second internal chamber receives the foodstuffs, the expansion headspace volume section is located above the surface of the foodstuffs, the second internal chamber having a length spanning first and second ends of the second internal chamber, and an elongated internal capillary leading from the first headspace volume of the first internal chamber at a location between the first and second ends of the first internal chamber to the expansion headspace section of the second internal chamber, said capillary formed between the two layers of flexible material to connect the first headspace volume section of the first internal chamber with the expansion headspace volume section of the second internal chamber;

(b) the filler opening configured to be sealable after receiving the foodstuff into the first internal chamber;

(c) a first control mechanism operable to permit and control, during thermal processioning of the foodstuffs as well as during and after the sealing of the first internal chamber, the flow of gases between the internal capillary and the first internal chamber but not permitting the flow of liquids and solids from the first internal chamber to the internal capillary;

(d) a second control mechanism for permitting and controlling the movement of gases from the expansion headspace section of the second internal chamber to the outside atmosphere during thermal processing; and (e) the second internal chamber after thermal processing of the foodstuffs being sealable to isolate the second control mechanism from the second internal chamber.

20. The flexible packaging assembly according to claim 19, wherein the first control mechanism comprises a two-way valve.

* * * * *